US009505522B2

(12) United States Patent
Perry et al.

(10) Patent No.: US 9,505,522 B2
(45) **Date of Patent: *Nov. 29, 2016**

(54) CONTAINER

(71) Applicant: ABBOTT LABORATORIES, Abbott Park, IL (US)

(72) Inventors: James P. Perry, Gahanna, OH (US); Craig A. McCardell, Rochester Hills, MI (US); Jeremy McBroom, Columbus, OH (US); David Compeau, Oxford, MI (US); Ashley A. Gohlke, Chicaco, IL (US); William J. Hook, Galena, OH (US); Katherine J. Jordan, Pickerington, OH (US); Frank S. Walczak, Galena, OH (US); Peter B. Clarke, Fairfield, CT (US); J. Kevin Clay, Milford, CT (US); Richard C. Darr, Medina, OH (US); Jack E. Elder, Rochester, MI (US); Marc A. Pedmo, Litchfield, OH (US); Charles R. Schotthoefer, Bloomfield, MI (US)

(73) Assignee: ABBOTT LABORATORIES, Abbott Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/483,852

(22) Filed: Sep. 11, 2014

(65) Prior Publication Data

US 2014/0374429 A1 Dec. 25, 2014

Related U.S. Application Data

(63) Continuation of application No. 13/892,052, filed on May 10, 2013, now Pat. No. 8,857,645, which is a continuation of application No. 13/083,207, filed on Apr. 8, 2011, now Pat. No. 8,511,499, which is a (Continued)

(51) Int. Cl.
*B65D 17/50* (2006.01)
*B65D 21/02* (2006.01)

(Continued)

(52) U.S. Cl.
CPC ..... *B65D 17/502* (2013.01); *B65B 3/04* (2013.01); *B65B 7/28* (2013.01); *B65D 21/02* (2013.01); *B65D 43/0235* (2013.01); *B65D 51/24* (2013.01); *B65D 53/00* (2013.01)

(58) Field of Classification Search
USPC ..... 220/4.21, 214, 254.3, 254.7, 310.1, 220/328, 378, 784, 788, 835
See application file for complete search history.

(56) References Cited

U.S. PATENT DOCUMENTS 711,452 A 10/1902 Meyer
2,648,097 A 8/1953 Kritchever (Continued)

FOREIGN PATENT DOCUMENTS

CN 2936980 8/2007
CN 201144030 11/2008

(Continued)

OTHER PUBLICATIONS

International Search Report and Written Opinion from PCT/US2013/038468 dated Aug. 11, 2013.

(Continued)

*Primary Examiner* — Fenn Mathew
*Assistant Examiner* — Madison L Poos
(74) *Attorney, Agent, or Firm* — Calfee, Halter & Griswold LLP

(57) ABSTRACT

A container (210) for holding granular or powdered material and formed by a top wall (212), a bottom wall (214), a front wall (216), a rear wall (218), a first side wall (220), and a second side wall (222). A rotatably removable lid (D) is interiorly mounted with a scoop (32) and is pivotally hinged to a collar (300) that includes a sealing gasket (330). The collar (300) mounts to the walls of the container (210). A sealing wall 240 of the lid (D) cooperates with the gasket 300 to prevent the contents from spilling. The container (210) incorporates powder control features, a container wall junction (50) preferred geometry and congruent scoop (32) enabling convenient access to the contents, a tolerance variation accommodating and strength improving, J-shaped collar (300) and interlocking indentations (290) and flex clips (310), and a pressure controlling portion (350) that prevents unwanted deformation due to pressure differentials.

98 Claims, 17 Drawing Sheets

Related U.S. Application Data continuation of application No. 12/520,652, filed as application No. PCT/US2007/088793 on Dec. 26, 2007, now Pat. No. 8,308,008, which is a continuation-in-part of application No. 11/645,887, filed on Dec. 27, 2006.

(60) Provisional application No. 61/014,595, filed on Dec. 18, 2007.

(51) Int. Cl.

| | |
|---|---|
| ***B65B 3/04*** | (2006.01) |
| ***B65B 7/28*** | (2006.01) |
| ***B65D 53/00*** | (2006.01) |
| ***B65D 51/24*** | (2006.01) |
| ***B65D 43/02*** | (2006.01) |

(56) References Cited

U.S. PATENT DOCUMENTS

| | | | |
|---|---|---|---|
| 3,038,624 | A | 6/1962 | Wieckmann |
| 3,187,920 | A | 6/1965 | Dorn |
| 3,338,468 | A | 8/1967 | Wilson |
| 3,613,964 | A | 10/1971 | Gronemeyer |
| 3,966,082 | A | 6/1976 | Hopkins |
| 4,000,816 | A | 1/1977 | Spruyt |
| 4,089,433 | A | 5/1978 | Jonsson |
| 4,095,716 | A | 6/1978 | Meany |
| 4,293,079 | A | 10/1981 | Lytle |
| 4,321,922 | A | 3/1982 | Deaton |
| 4,408,698 | A | 10/1983 | Ballester |
| 4,577,775 | A | 3/1986 | Kresin |
| 4,727,999 | A | 3/1988 | Gach |
| 4,736,870 | A | 4/1988 | Christensson |
| 4,883,193 | A | 11/1989 | Christensson |
| 4,917,261 | A | 4/1990 | Borst |
| 4,971,220 | A | 11/1990 | Kaufman et al. |
| 5,046,659 | A | 9/1991 | Warburton |
| 5,050,763 | A | 9/1991 | Christensson |
| 5,065,887 | A | 11/1991 | Schuh et al. |
| 5,078,296 | A | 1/1992 | Amidzich |
| 5,145,088 | A | 9/1992 | Goujon |
| 5,204,130 | A | 4/1993 | McDevitt et al. |
| 5,219,087 | A | 6/1993 | Christensson |
| D339,639 | S | 9/1993 | Ohnuma et al. |
| 5,305,900 | A | 4/1994 | Maguire et al. |
| 5,310,049 | A | 5/1994 | Bigelow et al. |
| 5,322,178 | A | 6/1994 | Foos |
| 5,337,911 | A | 8/1994 | Holub |
| 5,353,946 | A | 10/1994 | Behrend |
| 5,366,104 | A | 11/1994 | Armstrong |
| 5,383,558 | A | 1/1995 | Wilkinson et al. |
| 5,429,833 | A | 7/1995 | Wyslotsky |
| 5,515,993 | A | 5/1996 | McManus |
| 5,518,152 | A | 5/1996 | Burcham et al. |
| 5,582,314 | A | 12/1996 | Quinn et al. |
| 5,598,941 | A | 2/1997 | Semersky et al. |
| 5,641,084 | A | 6/1997 | Rice |
| 5,706,974 | A | 1/1998 | Murdick et al. |
| 5,718,350 | A | 2/1998 | Williams |
| 5,794,566 | A | 8/1998 | Goetz |
| 5,810,188 | A | 9/1998 | Novakoski et al. |
| 5,897,011 | A | 4/1999 | Brilliant et al. |
| 5,897,036 | A | 4/1999 | DeCoster et al. |
| 5,931,323 | A | 8/1999 | Wilkinson et al. |
| 5,997,052 | A | 12/1999 | Reeb et al. |
| 6,006,901 | A | 12/1999 | Pereira Da Silva |
| 6,042,000 | A | 3/2000 | Kawamoto |
| 6,238,762 | B1 | 5/2001 | Friedland et al. |
| D444,027 | S | 6/2001 | Gilliam et al. |
| 6,269,969 | B1 | 8/2001 | Huang |
| 6,308,858 | B1 | 10/2001 | Koefelda |
| 6,520,370 | B2 | 2/2003 | Nyman et al. |
| D473,140 | S | 4/2003 | Gilliam et al. |
| 6,609,633 | B1 | 8/2003 | Dyble et al. |
| 6,644,494 | B2 | 11/2003 | Hayes et al. |
| D484,797 | S | 1/2004 | Kipperman et al. |
| 6,761,279 | B1 | 7/2004 | Martin et al. |
| 6,761,283 | B1 | 7/2004 | Gilliam et al. |
| 6,772,904 | B1 | 8/2004 | Gilliam et al. |
| D504,318 | S | 4/2005 | Lane et al. |
| 6,889,866 | B2 | 5/2005 | Gilliam et al. |
| 6,964,359 | B1 | 11/2005 | Darr et al. |
| 7,040,500 | B2 | 5/2006 | Kipperman et al. |
| 7,080,754 | B2 | 7/2006 | Lown |
| D528,919 | S | 9/2006 | Kipperman et al. |
| D530,616 | S | 10/2006 | Kipperman et al. |
| D530,617 | S | 10/2006 | Little et al. |
| 7,156,265 | B2 | 1/2007 | Walsh et al. |
| 7,175,041 | B2 | 2/2007 | Ekkert |
| 7,370,788 | B1 | 5/2008 | Otani et al. |
| D576,035 | S | 9/2008 | Perry et al. |
| D578,401 | S | 10/2008 | Perry et al. |
| 7,621,417 | B2 | 11/2009 | Peterson et al. |
| D640,544 | S | 6/2011 | Sifuentes et al. |
| 8,308,008 | B2 | 11/2012 | Perry et al. |
| D675,477 | S | 2/2013 | McGrath et al. |
| 8,469,223 | B2 | 6/2013 | Perry et al. |
| 8,511,499 | B2 | 8/2013 | Perry et al. |
| 2001/0035424 | A1 | 11/2001 | Combe et al. |
| 2002/0117504 | A1 | 8/2002 | Emerson et al. |
| 2002/0190112 | A1 | 12/2002 | Culeron et al. |
| 2003/0015542 | A1 | 1/2003 | Nulty et al. |
| 2003/0072440 | A1 | 4/2003 | Murray et al. |
| 2003/0121941 | A1 | 7/2003 | Walsh et al. |
| 2003/0183540 | A1 | 10/2003 | Onishi |
| 2003/0218020 | A1 | 11/2003 | Gilliam et al. |
| 2004/0011811 | A1 | 1/2004 | McLelland et al. |
| 2004/0118848 | A1 | 6/2004 | Marshall |
| 2004/0159661 | A1 | 8/2004 | Aochi |
| 2004/0238553 | A1 | 12/2004 | Lane et al. |
| 2005/0035118 | A1 | 2/2005 | Garg et al. |
| 2005/0173442 | A1 | 8/2005 | Gilliam et al. |
| 2005/0247708 | A1 | 11/2005 | Golden |
| 2005/0247709 | A1 | 11/2005 | Atkins et al. |
| 2006/0027585 | A1 | 2/2006 | Clamage |
| 2006/0042897 | A1 | 3/2006 | Sanderson |
| 2006/0076352 | A1 | 4/2006 | Peterson et al. |
| 2006/0081641 | A1 | 4/2006 | Habeger et al. |
| 2006/0131347 | A1 | 6/2006 | Nottingham et al. |
| 2006/0156811 | A1 | 7/2006 | Borowski et al. |
| 2006/0191933 | A1 | 8/2006 | Hicks et al. |
| 2006/0201946 | A1 | 9/2006 | Witt |
| 2006/0207963 | A1 | 9/2006 | Little et al. |
| 2006/0219652 | A1 | 10/2006 | Grant et al. |
| 2006/0273118 | A1 | 12/2006 | Walsh et al. |
| 2007/0015046 | A1 | 1/2007 | Kim et al. |
| 2007/0045315 | A1 | 3/2007 | Evans et al. |
| 2007/0221605 | A1 | 9/2007 | Pugne et al. |
| 2007/0235462 | A1 | 10/2007 | Omdoll et al. |
| 2007/0284276 | A1 | 12/2007 | Luttik et al. |
| 2008/0035637 | A1 | 2/2008 | Shehadey et al. |
| 2008/0041861 | A1 | 2/2008 | Crawford et al. |
| 2008/0156805 | A1 | 7/2008 | Perry et al. |
| 2008/0156806 | A1 | 7/2008 | Perry et al. |
| 2008/0156808 | A1 | 7/2008 | Perry et al. |
| 2008/0156858 | A1 | 7/2008 | Perry et al. |
| 2008/0173657 | A1 | 7/2008 | Perry et al. |
| 2009/0014457 | A1 | 1/2009 | Bennett |
| 2009/0032545 | A1 | 2/2009 | Zeiler et al. |
| 2009/0039708 | A1 | 2/2009 | Sanfilippo et al. |
| 2009/0152280 | A1 | 6/2009 | Luburic |
| 2009/0159607 | A1 | 6/2009 | Kratzer |
| 2009/0230177 | A1 | 9/2009 | Robertson et al. |
| 2009/0255942 | A1 | 10/2009 | Omdoll et al. |
| 2009/0289066 | A1 | 11/2009 | DiPietro et al. |
| 2009/0314775 | A1 | 12/2009 | Dietrich et al. |
| 2010/0108670 | A1 | 5/2010 | Perry et al. |
| 2010/0180553 | A1 | 7/2010 | Tilton |
| 2010/0264156 | A1 | 10/2010 | Vandamme et al. |
| 2010/0294767 | A1 | 11/2010 | Catteau et al. |
| 2010/0308044 | A1 | 12/2010 | Perry et al. |
| 2010/0308065 | A1 | 12/2010 | Vandamme et al. |
| 2010/0308066 | A1 | 12/2010 | Perry et al. |

(56) References Cited

U.S. PATENT DOCUMENTS

| | | | |
|---|---|---|---|
| 2011/0006066 | A1 | 1/2011 | Vandamme et al. |
| 2011/0186570 | A1 | 8/2011 | Perry et al. |
| 2014/0097183 | A1 | 4/2014 | McGrath |
| 2015/0129597 | A1 | 5/2015 | McBroom |

FOREIGN PATENT DOCUMENTS

| | | |
|---|---|---|
| DE | 19701101 | 7/1998 |
| DE | 19725698 | 12/1998 |
| EP | 0356322 | 1/1993 |
| EP | 0648681 | 1/1994 |
| EP | 0609650 | 8/1994 |
| EP | 0700836 | 8/1995 |
| EP | 0631941 | 9/1996 |
| EP | 0957034 | 11/1999 |
| EP | 1129957 | 9/2001 |
| EP | 1156157 | 11/2001 |
| EP | 1512637 | 3/2005 |
| EP | 1336569 | 6/2005 |
| EP | 1529737 | 3/2007 |
| FR | 2719558 | 11/1995 |
| FR | 2747107 | 10/1997 |
| GB | 2059920 | 4/1981 |
| JP | 8183556 | 7/1996 |
| JP | 8217108 | 8/1996 |
| JP | 10258841 | 9/1998 |
| JP | 2001019006 | 1/2001 |
| JP | 2002209770 | 7/2002 |
| JP | 2004136959 | 5/2004 |
| JP | 2004329382 | 11/2004 |
| JP | 2005022757 | 1/2005 |
| JP | 2006111294 | 3/2006 |
| JP | 2006160299 | 6/2006 |
| JP | 2007099281 | 4/2007 |
| JP | 2007099287 | 4/2007 |
| JP | 2007099294 | 4/2007 |
| JP | 2007137510 | 6/2007 |
| JP | 2008063009 | 3/2008 |
| JP | 2008296929 | 12/2008 |
| KR | 20020007210 | 1/2001 |
| KR | 20020025817 | 4/2002 |
| KR | 20030072440 | 9/2003 |
| KR | 20030089935 | 11/2003 |
| KR | 10-2002-0040057 | 1/2004 |
| KR | 20040005481 | 1/2004 |
| KR | 20050027042 | 3/2005 |
| KR | 20050019526 | 12/2005 |
| KR | 2004030400000 | 12/2005 |
| KR | 10-2002-0027862 | 4/2009 |
| NL | 1031829 | 11/2007 |
| WO | 9317920 | 9/1993 |
| WO | 9511834 | 5/1995 |
| WO | 9846494 | 10/1998 |
| WO | 9915423 | 4/1999 |
| WO | 0151378 | 7/2001 |
| WO | 03051732 | 6/2003 |
| WO | 2005075314 | 8/2005 |
| WO | 2007131806 | 11/2007 |
| WO | 2007137776 | 12/2007 |
| WO | 2007142522 | 12/2007 |
| WO | 2008019980 | 2/2008 |
| WO | 2008083141 | 7/2008 |
| WO | 2008149006 | 12/2008 |
| WO | 2008149007 | 12/2008 |
| WO | 2009081050 | 7/2009 |
| WO | 2010141841 | 12/2010 |
| WO | 2013163583 | 10/2013 |

OTHER PUBLICATIONS

International Search Report for PCT/US2007/088793 dated Jun. 10, 2008.
International Preliminary Report on Patentability for PCT/US2007/088793 dated Jun. 30, 2009.
International Search Report for PCT/US2010/037436 dated Aug. 12, 2010.
International Search Report and Written Opinion from PCT/US2010/037436 dated Aug. 9, 2013.
Notice of Abandonment for U.S. Appl. No. 11/645,887 dated Dec. 5, 2008.
Notice of Abandonment for U.S. Appl. No. 11/964,491 dated Dec. 5, 2008.
Notice of Abandonment for U.S. Appl. No. 11/964,513 dated Dec. 5, 2008.
Notice of Abandonment for U.S. Appl. No. 11/964,526 dated Dec. 5, 2008.
Notice of Abandonment for U.S. Appl. No. 11/964,547 dated Dec. 5, 2008.
Restriction/Election for U.S. Appl. No. 12/478,885 dated Nov. 25, 2011.
Response to Restriction/Election for U.S. Appl. No. 12/478,885 dated Dec. 16, 2011.
Office Action in U.S. Appl. No. 12/478,885 dated Mar. 13, 2012.
Amendment A/Response to Office Action in U.S. Appl. No. 12/478,885 dated May 17, 2012.
Office Action in U.S. Appl. No. 12/478,885 dated Oct. 19, 2012.
Office Action in U.S. Appl. No. 12/520,652 dated Dec. 12, 2011.
Response/Amendment A in U.S. Appl. No. 12/520,652 dated Mar. 5, 2012.
Final Office Action in U.S. Appl. No. 12/520,652 dated May 10, 2012.
Response/Amendment B in U.S. Appl. No. 12/520,652 dated Jun. 28, 2012.
Notice of Allowance in U.S. Appl. No. 12/534,320 dated Mar. 21, 2013.
Notice of Allowance in U.S. Appl. No. 12/520,652 dated Jul. 11, 2012.
Office Action in U.S. Appl. No. 12/534,320 dated Mar. 22, 2012.
Amendment A/Response to Office Action in U.S. Appl. No. 12/534,320 dated May 25, 2012.
Office Action in U.S. Appl. No. 12/534,320 dated Nov. 28, 2012.
Office Action from U.S. Appl. No. 13/892,052 dated Jan. 16, 2014.
Preliminary Amendment A in U.S. Appl. No. 13/083,207 dated Apr. 8, 2011.
Preliminary Amendment B in U.S. Appl. No. 13/083,207 dated Apr. 13, 2011.
Office Action in U.S. Appl. No. 13/083,207 dated Sep. 5, 2012.
Response to Office Action in U.S. Appl. No. 13/083,207 dated Dec. 5, 2012.
Notice of Non-Compliant Amendment in U.S. Appl. No. 13/083,207 dated Dec. 11, 2012.
Response to Notice of Non-Compliant Amendment in U.S. Appl. No. 13/083,207 dated Jan. 3, 2013.
Notice of Allowance in U.S. Appl. No. 13/083,207 dated Jan. 24, 2013.
Office Action in Columbian Appl. No. 09066736 dated Sep. 18, 2012.
Office Action in Israeli Appl. No. 199511 dated Feb. 10, 2012.
Office Action in Israeli Appl. No. 199511 reported by Foreign Associate Jul. 9, 2013.
Office Action in Japanese Appl. No. 2009-544244 dated Jul. 31, 2012.
Office Action in Mexican Appl. No. MX/a/2009/007052 dated Mar. 1, 2012.
ASG vitamin package of 1990.
Hardware Source hinge store-where-you find all the hinges you will ever need, www.hardwaresource.com/index.asp. Dec. 26, 2006, pp. 1-3.
Living Hinge Design, http://engr.bd.psu.edu/pkoch/plasticdesignliving_hinge.htm, Nov. 6, 2006, pp. 1-8.
Living Hinge, http://efunda.com/designstandards/plastic_design/hinge.cfm Nov. 2, 2006 pp. 1-3.
Request for Inter Partes Reexamination of U.S. Pat. No. 7,040,500 dated Nov. 7, 2008, pp. 1-97.
Office Action for Dominican Republic Patent Application No. P2009-0158 reported by associate Jul. 25, 2013.

(56) References Cited

OTHER PUBLICATIONS

Notice of Allowance from U.S. Appl. No. 12/478,885 dated Sep. 18, 2013.
International Search Report from PCT/US2013/038468 dated Nov. 8, 2013.
Response to Office Action from U.S. Appl. No. 13/892,052 dated May 16, 2014.
Notice of Allowance from U.S. Appl. No. 13/892,052 dated Aug. 6, 2014.
Exam Report from MY Application No. PI 20092696 dated Apr. 15, 2014.
Restriction Requirement from U.S. Appl. No. 29/470,645 mailed Jan. 2, 2015.
Office Action from CA Application No. 2,674,004 dated Apr. 7, 2014.
Office Action from CA Application No. 2,674,004 dated Mar. 3, 2015.
First Exam Report from New Zealand Application No. 630929 dated May 25, 2015.
Response to Restriction/Election for U.S. Appl. No. 29/470,645 dated Feb. 24, 2015.
Notice of Allowance from U.S. Appl. No. 29/470,645 dated Mar. 6, 2015.
Office Action from U.S. Appl. No. 14/395,841 dated Aug. 14, 2015.
Notice of Allowance from U.S. Appl. No. 29/523,835 dated Oct. 19, 2015.
Search Report and Written Opinion from Singapore Application No. 11201406809T dated Sep. 17, 2015.
Office Action from Canadian Application No. 2,892,925 dated Oct. 7, 2015.
Communication from EP Application No. 07869878.4 dated Sep. 15, 2015.
Extended European Search Report from European Application No. 16162082.8 dated Sep. 20, 2016.

FIG. 24
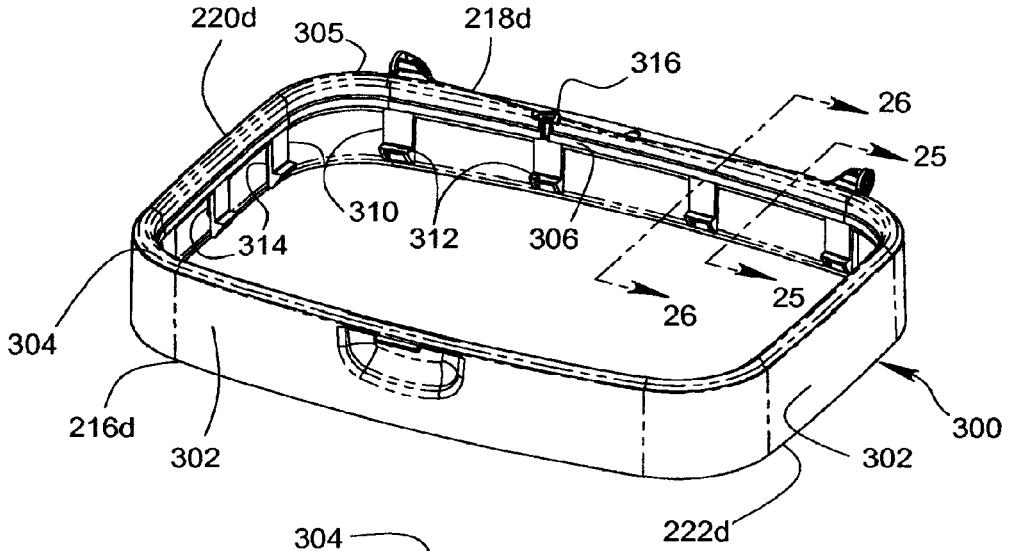
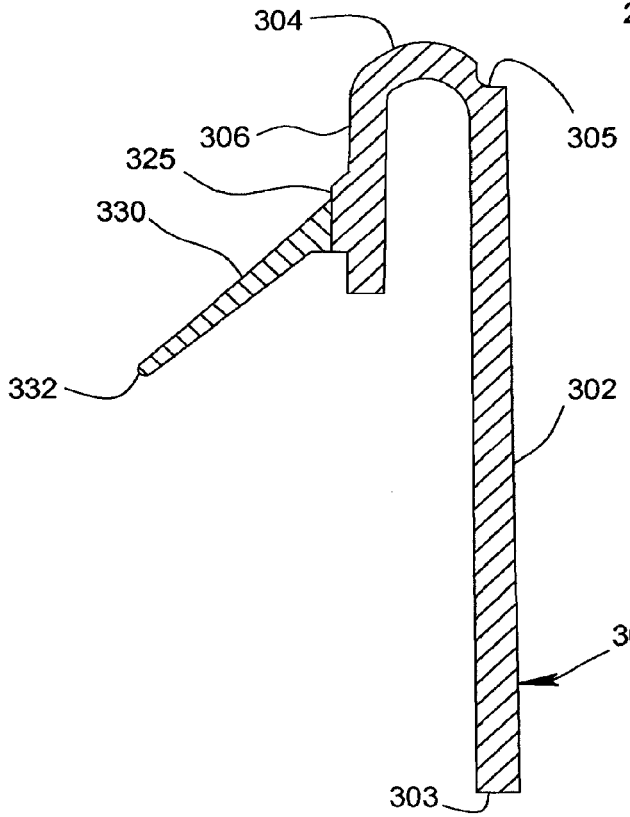
FIG. 25

FIG. 37
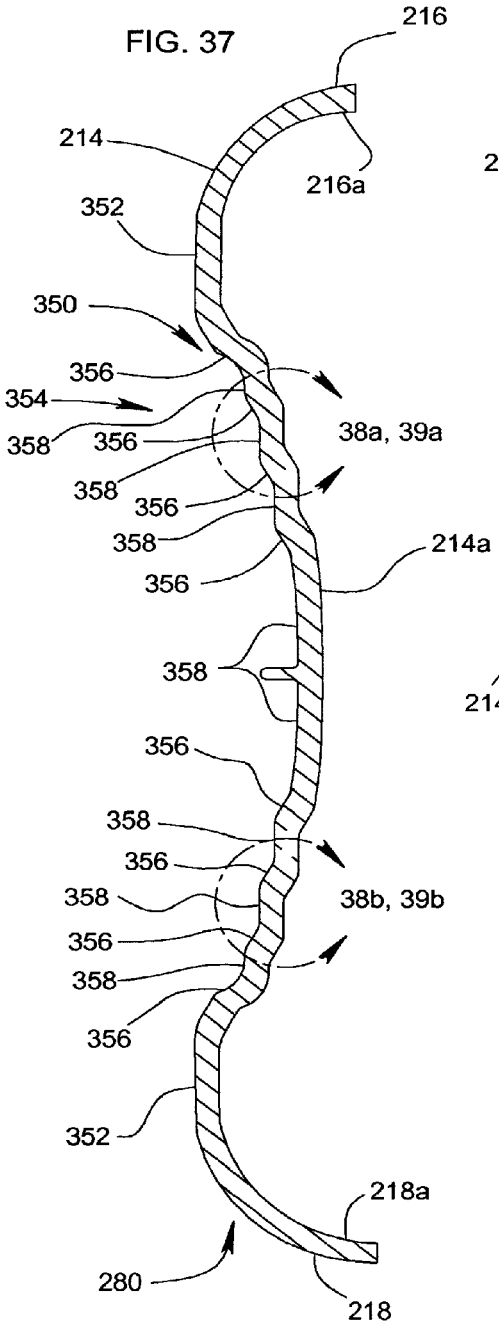
FIG. 38a
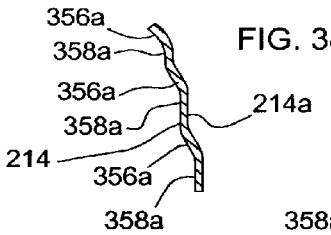
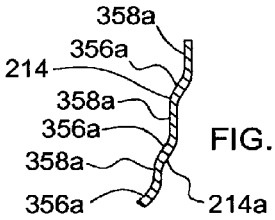
FIG. 38b
FIG. 39a
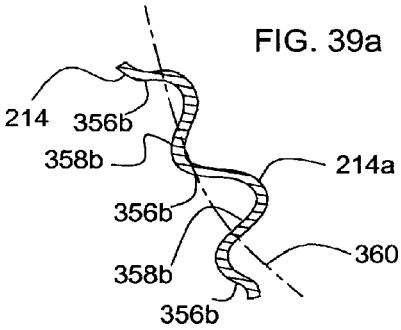
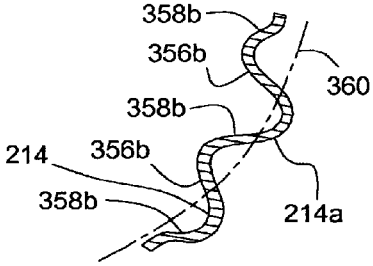
FIG. 39b

CONTAINER

PRIORITY CLAIM TO RELATED APPLICATION

This application is a continuation application of U.S. patent application Ser. No. 13/892,052, filed May 10, 2013, which is a continuation application of U.S. patent application Ser. No. 13/083,207, filed Apr. 8, 2011, issued Aug. 20, 2013 as U.S. Pat. No. 8,511,499, which is a continuation of U.S. patent application Ser. No. 12/520,652, filed Jan. 13, 2010, issued Nov. 13, 2012 as U.S. Pat. No. 8,308,008, which is a national stage application of International Application No. PCT/US07/88793 filed Dec. 26, 2007, which claims the benefit of the earlier filing date of commonly owned U.S. patent application Ser. No. 11/645,887, filed Dec. 27, 2006 now expired), and No. 61/014,595, filed Dec. 18, 2007, all of which are hereby incorporated by reference in their entirety as though fully set forth in the present application.

BACKGROUND OF THE INVENTION

Field of the Invention

This invention relates to the field of packaging, and more particularly, packaging for granulated products, such as for example, a powder.

Description of Related Art

Currently, products in granular or powdered form, such as, for purposes of example without limitation, infant formula, flour, coffee, sugar, are packaged in containers. Scoops are provided within the package for measured dispensing of such contents. Consumers or users of such containers have found that the current packaging is difficult to handle with a single hand, and have found that it is difficult to open the container and to locate and remove the scoop from the packaging upon the first use without experiencing spillage. Once the lid of the container is removed and/or opened, the contents are often loosely caked or packed into parts of the interior of the lid or top of the container, which leads to spillage as the contents fall away from the lid or top. While some of the falling powder may fall back into the interior of the container, much of it is wasted and contaminated as it spills onto the surrounding workspace. Additionally, prior containers do not offer adequate sealing of the contents after the container has been opened for the first time. This leads to the undesirable and inadvertent leaking or escape of the contents from various poorly sealed areas of the container.

When the user wishes to withdraw a portion of the product from the container, she must first dig around in the interior of the container with her fingers to find the scoop. This search and locate process contaminates the contents and soils the hands of the user, which can lead to more unwanted spillage as the powder-coated fingers and hands are removed from the interior of the container. Once located, the scoop is withdrawn so that it can be used, and the scoop is also coated with the contents. The bowl of the scoop is also caked or packed with the contents. As the coating of powder and the packed bowl of powder loosen during the removal process, more contents are contaminated and wasted as the coating falls away from the hands, fingers, and scoop, and as any powder caked in the bowl loosens and falls.

Additional problems have been experienced with scoops that are positioned in a more convenient location, perhaps against an interior or exterior wall. These additional problems include difficulty in grasping the scoop, which may be tightly fastened with adhesive against the wall and/or with a mechanical retainer or fastener that leaves very little clearance between the scoop and surrounding structure of the container for grasping the scoop. These undesirable configurations typically will require more than one free hand for removal and grasping of the scoop.

Once the scoop is located and gripped by the user, it can be used to withdraw and dispense the desired amount of product. Typically, the scoop is then placed back into the container and the lid is replaced to close the container. The next time the product is to be withdrawn from the container, the process of searching for the buried and powder-coated scoop is repeated. U.S. Pat. No. 5,706,974 discusses the problem of storage of the scoop outside of the granular or powdered product.

Users have also found that it is difficult to remove the last bit of powder from the nearly empty container because the shape of the container includes tight and closed spaces that are inaccessible to the scoop, and which has other areas having a shape that is different than the shape of the scoop. As a result, a user must resort to inverting the container to completely empty the contents, which creates another instance of spillage and wasted contents.

Manufacturers of such containers have also experienced a number of challenges in fabricating the containers when using various types of optionally preferred thermo-forming and polymeric manufacturing processes and materials. In many prior art attempts to manufacture such containers, various thermo-molding processes are used. Those skilled in the relevant arts have long known about the difficulty in producing various types of packaging containers using thermo-formed polymeric materials.

Such materials are subject to many variables that adversely and unexpectedly result in product components being produced that can vary beyond acceptable dimensional tolerance limits, which results in the need to scrap defective containers and components of such container, and the need to produce replacements. Also, polymeric materials can render mis-shaped component profiles due to unexpected shrinkage and warping, and other thermo-forming anomalies that leave entire production runs of containers and components for containers destined for the scrap heap.

These types of manufacturing problems are especially pronounced in containers formed from assemblies that incorporate more than one component, such as where a top or lid and a collar assembly are fastened to a bottom part of the container. Problems in assembling such components can result if one or both of the components are out of tolerance or otherwise mis-shaped. Even where it is sometimes possible to assemble improperly dimensioned or mis-shaped components, most polymeric container configurations have long been in need of improved strength and rigidity characteristics to overcome such anomalies and to render such containers more durable for use in a wider array of environments.

Still other users experience problems with prior art containers that are inadequate for use in circumstances where the ambient air pressure external to the container changes drastically so as to create a significant pressure differential between the sealed interior space of the container and the external, ambient atmosphere. This situation is most apparent in situations where a manufacturer produces containers that are filled and sealed at a factory located at an altitude at or near sea level.

When such sea-level pressure containers are shipped to consumers located at higher altitudes or elevations, the container packaging will have a higher internal pressure, which creates a pressure differential that can be significant.

If the pressure differential is large enough, the container may become distended making it difficult to stack and store, and may even experience a breach, leading to contaminated and wasted product. The opposite situation can occur when containers that are filled and sealed at a higher altitude are shipped to lower altitude users. Upon opening, ambient air can rush into the interior space of the container and contaminate the contents.

When a container having a pressure differential is opened, the contents may again spill due to the very rapid pressure equalization ejecting a cloud of powdered or other type of product contents. Attempts to overcome these disadvantages have included thicker walled containers, which increases weight and material costs, as well as round and cylindrical containers that may have higher hoop stress strength, but which are less efficient and convenient to stack and store on a shelf.

What has long been needed in the field of art is a container that addresses the many issues surrounding prior art containers, and which most importantly offers new and innovative ways to prevent and/or minimize contamination, spillage, and waste of product contained in such containers. A container has been sought that better enables access to the last bit of powder in a nearly empty container without the need to invert the container. It is also advantageous to create a container that enables more convenient access to a scoop for dispensing the powder. A container package that can be easily manipulated by one hand while leaving the other hand free for opening and dispensing is particularly needed for a variety of applications. A container that is easy to handle, grip, and to transport in quantity and to stack and store on a shelf has also been needed for a long time.

Many attempts have still fallen far short of creating a more durable container that incorporates improved rigidity and strength characteristics that can expand the range of acceptable dimensional tolerances and that can adapt to and more readily accommodate unexpected mis-shaped container component profiles. The field of art continues to have a need for a container that can better withstand pressure differentials without compromise of the container, and which can minimize the inconvenience of spillage and wasted product due to a rapidly expelled cloud of product if the container is opened while subjected to a pressure differential.

SUMMARY OF THE INVENTION

Many of the problems of the prior art are addressed with the innovative sealable containers of the invention, which enable previously unavailable features including improved sealing capabilities, new ways to control spillage of powdered contents, new integrated dispensing scoops, and strengthened containers that can protect against spillage and damage to product due to adverse pressure differentials between the sealed product container and the external environment. In one preferred configuration of the invention, a sealable container includes walls defining interior and exterior surfaces and an interior space. The walls can preferably have an upper portion near an upper end of the walls that defines a sealing flange that includes an internal edge, which defines an opening to the interior space of the container. The sealable container also incorporates a collar having an interior surface which fits around the container near the upper portion, which together define a subcollar space between the exterior surface of the container and the interior surface of the collar.

The preferred sealable container also includes a removable lid that is pivotally or hingedly attached to the collar and which has an interior surface that, when the lid is in a closed position, covers and seals the opening of the interior space of the container. The lid preferably has a sealing wall that depends from the surface of the lid and projects toward the sealing flange of the collar, and which is dimensioned or sized to remain inward of the sealing flange when the lid is closed. In variations of any of the embodiments of the invention, the sealing wall of the lid can be used alone and in place of contemplated integral or flexible gaskets, and may also be used in combination therewith.

Even more preferably, the container includes in certain optionally preferred embodiments either an integrally formed gasket carried from the collar and/or a separately formed flexible gasket, either of which are preferably dimensioned to removably rest against the sealing flange. The gasket can be carried from a surface of the container such as the interior surface of the collar, the interior surface of the walls, or the sealing wall of the lid, as well as combinations thereof and wherein more than one gasket may be preferred for use. When the lid is in the closed position, the gasket, the sealing wall and the sealing flange are arranged and dimensioned so that the sealing wall biases the flexible gasket against the internal edge of the sealing flange to seal the subcollar space from the container interior, which prevents the contents of the container from spilling into the subcollar space.

In variations of these embodiments, the sealable container may also incorporate a modified collar that includes a raised seat or similar feature that carries the gasket or to which the gasket is affixed. As with other versions of the invention, the raised seat is configured so that that gasket projects inwardly to bias against and to extend beyond the internal edge of the sealing flange, which also serves to control spillage of the contents of the container. More preferably, the gasket can be arranged to remain biased against the sealing flange when the lid is in an open position.

In additionally preferred and optional embodiments of the invention, the sealable container can also include a removable seal that is substantially impervious to air, water, and even light if desired. The impervious seal preferably extends across the opening to seal the interior space and attaches to the sealing flange. In variations where the flexible gasket is included, the impervious seal preferably is situated underneath the gasket, and the flexible gasket flexes to enable removal of the removable seal and thereafter flexes back to rest against the sealing flange.

In most embodiments of the inventive container, the lid is rotatably, hingedly, and/or pivotally connected to the container with a live or mechanical hinge mounted between the lid and the collar so that the lid can move between open and closed positions. In certain preferred configurations of the invention, the novel sealable container is arranged wherein its walls form the container to have an approximately cuboid shape. However, the present invention is susceptible for use in cylindrical, rectilinear, obloid, and many other types of container packaging and for use with all kinds of containerized substances including fluids as well as powdered and granular materials.

Some modifications of the embodiments of the invention also contemplate inclusion of a removable scoop and a scoop holder that can be attached to the interior surface of the lid for holding a scoop. The most typical scoops have a bowl that is carried from a handle. The scoop holder of the invention is formed with a first bowl cover bracket and has a retainer that immobilizes the handle. A first projection is also included that extends from the interior surface of the lid and which has a handle holding notch that holds the handle away from the interior surface in a grasping position so that it is easy for a user to grasp and remove the scoop from the scoop holder.

In still other variations of any of the embodiments of the inventive sealable container, the sealing wall of the lid can be further modified to funnel inwardly toward a lower edge, either by a curved inwardly directed tapering of a lower edge of the sealing wall, or by a inwardly slanted or inclining tapering thereof, or by a combination thereof.

The new and novel sealable container also contemplates further modified lid arrangements that are compatible for use with any of the embodiments, modifications, and variations of the invention. Such lid configurations are directed at improving control of powdered contents, and the improvements preferably or optionally include the lid having a substantially domed central section that is dimensioned to be smaller than the sealing wall of the lid. More preferably, the substantially domed central section is joined to the lid by either the sealing wall or an angled wall, or both, wherein the angled wall tapers from the domed central section down to the interior surface of the lid at a point that is proximate to the sealing wall. The novel capability and benefits of the substantially domed central section are evident upon righting a disoriented container in that the angled wall and the sealing wall cooperate to direct any powder contents that may have accumulated within or become packed against the interior surface of the lid, down into the interior space of the container, which prevents entry into the subcollar space and other forms of spillage off of the lid upon opening the container. Preferably, the angled tapered wall can have an angle relative to a vertical direction of between about 10 and 75 degrees, and more preferably between about 25 and 45 degrees, and even more preferably about 30 degrees.

Many variations of possible domed lid configurations according to the principles of the invention are contemplated and can include, for purposes of example without limitation, the substantially domed central section extending to the sealing wall to define an area between approximately 20 percent and approximately 80 percent smaller than the entire area defined by the removable lid. Still other variations of the domed lid can be used with any of the inventive embodiments and include the substantially domed central section to project upwardly with a height dimension that is between approximately 10 percent and approximately 60 percent of a cumulative lid height dimension. In one embodiment, the domed area is dimensioned to contain a volume sufficient for storing a scoop, as described later.

As before and as described elsewhere herein, the innovative sealable container embodiments can be further modified to have the walls joining each other and joining a bottom surface of the container to define junctions that have a unique and/or predetermined or a particular cross-sectional geometry. In these variations of any of the embodiments of the invention, a modified scoop is incorporated for removing contents from the interior space of the container. The modified scoop includes a bowl that has a rim which is substantially congruent to the particular cross-sectional geometry of the junctions between the walls and between the walls and the bottom surface of the container.

This arrangement enables a user to conveniently remove all of the contents of the container, whether powder or fluid, without the need to invert the container, which can result in unwanted spillage. These variations contemplate the particular cross-sectional geometry of the junctions between the walls and between the walls and the bottom surface to include any one of a number of geometries including, for purposes of example without limitation, a right angle, multiple angles such as multiple obtuse angles, and curvilinear geometries including a circular geometry having a particular radius. For each of these respective geometries, the rim of the scoop bowl includes a portion that is substantially congruent to the respective geometry, and/or which is flexible and/or deformable upon use to be made congruent thereto.

The sealable container of the present invention also can include many different strength and rigidity improving features that can include the walls of the container having the upper portion defining on the exterior surfaces a plurality of interiorly projecting indentations or recesses that are spaced apart by strengthening or stabilizing bridges. The indentations preferably include a downwardly facing top surface or upper lug ledge. The collar is also modified to include a plurality of spaced apart flex clips or engagement lugs that are formed with retainer faces or upwardly facing surfaces. The flex clips preferably depend downwardly into the subcollar space and are positioned or juxtaposed to align with the plurality of indentations when the collar is fitted over the upper portion of receptacle of the container.

This arrangement enables the upwardly facing surfaces to engage the downwardly facing top surfaces whereby the flex clips hold the collar to the upper end of the container. The flex clips may also preferably incorporate one or more stiffeners that increase the strength and rigidity of the flex clips to optimize engagement strength. The stiffeners also serve to improve an alignment capability established by the flex clips, which effectively center and align the collar about the upper portion of the container as the collar is fitted onto the upper portion of the walls of the container.

Additionally preferred variations of the flex clip and indentation modification include the upwardly facing surfaces being dimensioned to be smaller than the downwardly facing surfaces of the indentations so that the collar and container can absorb dimensional tolerance errors and enable the collar to fit around the upper portion of the container even if they are not sized exactly as may be desired for a perfect fit. Further preferable modifications to the various embodiments of the inventive sealable container include at least one of the collar and the upper portion of the walls to be formed from a substantially flexible material.

Using a flexible material such a polymeric material like polypropylene and/or polyethylene will enable at least one of the collar and the upper portion of the walls to flex to absorb dimensional tolerance errors and enable the collar to fit around the upper portion of the container. Either of these innovative adaptations are suitable for use with all of the variations of the embodiments of the invention and can, as a result, also accommodate shape errors and mismatch between at least one of the collar and the upper portion of the walls to enable the collar to fit around the upper portion of the walls, even when unexpectedly or undesirably misshaped collars and/or receptacles are encountered during manufacture and assembly.

In yet another particularly preferred and optional modification to the various embodiments of the invention described herein, the sealable container employs a modified collar having a substantially J-shaped and/or U-shaped, upside-down cross-section. In this variation, the J or U shaped cross section includes an outward projecting long wall, a substantially rounded, stiffening top portion, and an inward short wall that cooperate to define the subcollar space.

The invention is susceptible to still further optionally preferred variations wherein the container is strengthened by incorporating the plurality of indentations and the plurality of spaced apart fins or flex clips to be positioned in an oppositely paired relationship. In the application of a substantially cuboid container shape, the opposite pairing is established across opposite facing walls of the container, using generally 2-6 fins or clips per side. However paired, a force vector coupling is established between each of the pairs. This increases rigidity and structural stability and strength of the sealable container, and tends to absorb any tolerance mismatches when the collar is fitted onto the upper portion. Additionally, this particular arrangement of flex clips and indentations enables an aligning capability between the collar and the upper portion of the walls, which can be useful during assembly of the inventive sealable containers. The flex clips can be further strengthen by including at least one stiffening rib on one of more of the flex clips.

Still other contemplated modifications are suitable for use with all of the modifications, variations, adaptations already described, which include the bottom surface including pressure control features that can prevent deformation of the container, and which can also be adapted to enable controlled deformation to relieve stress on the container due to internal pressure being higher than an external ambient atmospheric pressure, which can occur when a sealed container is subjected to pressure changes due to altitude changes and/or other types of crushing forces that may be experienced during manufacture, filling with product, and during use and transit.

In this adaptation of the preferred embodiments of the invention, the bottom surface includes a pressure control portion that is otherwise referred to as a central raised stiffener portion, which contrary to the plain meaning of the word stiffener, may also incorporate a flexible and/or collapsible pressure relief section. An outer planar portion that is substantially flat for resting on a surface surrounds the central raised stiffener portion. The central raised stiffener portion preferably projects or is directed towards the interior space in a plurality of steps having riser and tread portions, the riser portions generally project in a direction substantially upward relative to the outer planar portion and the tread portions are approximately parallel to the outer planar portion. The plurality of these riser and tread steps further contemplate multiple variations.

In one version, the steps are stiffened by thickening in a cross-section to resist deformation due to pressure changes relative to the pressure inside the sealed container. In another complementary version that can be used alone or in combination with the stiffened variation, an accordion or bellowed type arrangement of the steps or series of steps are included, which flex or deform in response to pressure changes external to the sealable container so as to lessen the net pressure differential between the interior of the sealable container and the ambient outside pressure.

In still other variations of the embodiments of the invention, a sealable container includes a top wall, a bottom wall, a front wall, a rear wall, a first side wall, and a second side wall. Each of the walls has a substantially rectangular shape. The rectangular shape of each wall enables the container to be stored easily on a shelf or counter-top. The top wall and portions of the front wall, the rear wall, the first side wall, and the second side wall form a lid. The lid is pivotally attached to the rear wall by a hinge. The lid can be opened by rotation thereof about the hinge. The front wall has at least one recess and the rear wall has at least one recess. The at least one recess of the front wall and the at least one recess of the rear wall are adjacent to the first side wall. The recesses provide a grip feature, which enables the user to manipulate the lid of the container with one hand when the container rests on a flat surface, e.g., a tabletop or a counter top. The container is preferably made of a polymeric material.

The container provided herein is suitable for holding granular material or powdered material, the container having a scoop furnished therewith. The scoop has a handle and a bowl. The interior of the container is characterized by having corners that are congruent with the bowl of the scoop furnished with the container. The congruency of the bowl of the scoop with the corners of the container enables the user to remove the last bit of powder remaining in the container. A flexible seal can be applied to the interior of the container to provide a substantially moisture-impervious, oxygen-impervious seal for the granular material or powdered material.

The lid is furnished with a scoop holder, whereby the scoop can be stored outside the bulk of the contents of the container to enable easy, clean access to the contents of the container. The container can be opened and closed with a single hand.

These variations, modifications, and alterations of the various preferred and optional embodiments may be used either alone or in combination with one another and with the features and elements already known in the prior art and also herein described, which can be better understood by those with relevant skills in the art with reference to the following detailed description of the preferred embodiments and the accompanying figures and drawings.

BRIEF DESCRIPTION OF THE DRAWING(S)

Without limiting the scope of the present invention as claimed below and referring now to the drawings and figures, wherein like reference numerals, and like numerals with primes, across the drawings, figures, and views refer to identical, corresponding, or equivalent elements, methods, components, features, and systems:

FIG. 1 is a perspective view of one embodiment of the container described herein. In this figure, the lid of the container is closed. This figure shows a side of the container having a grip feature.

Figure 13:
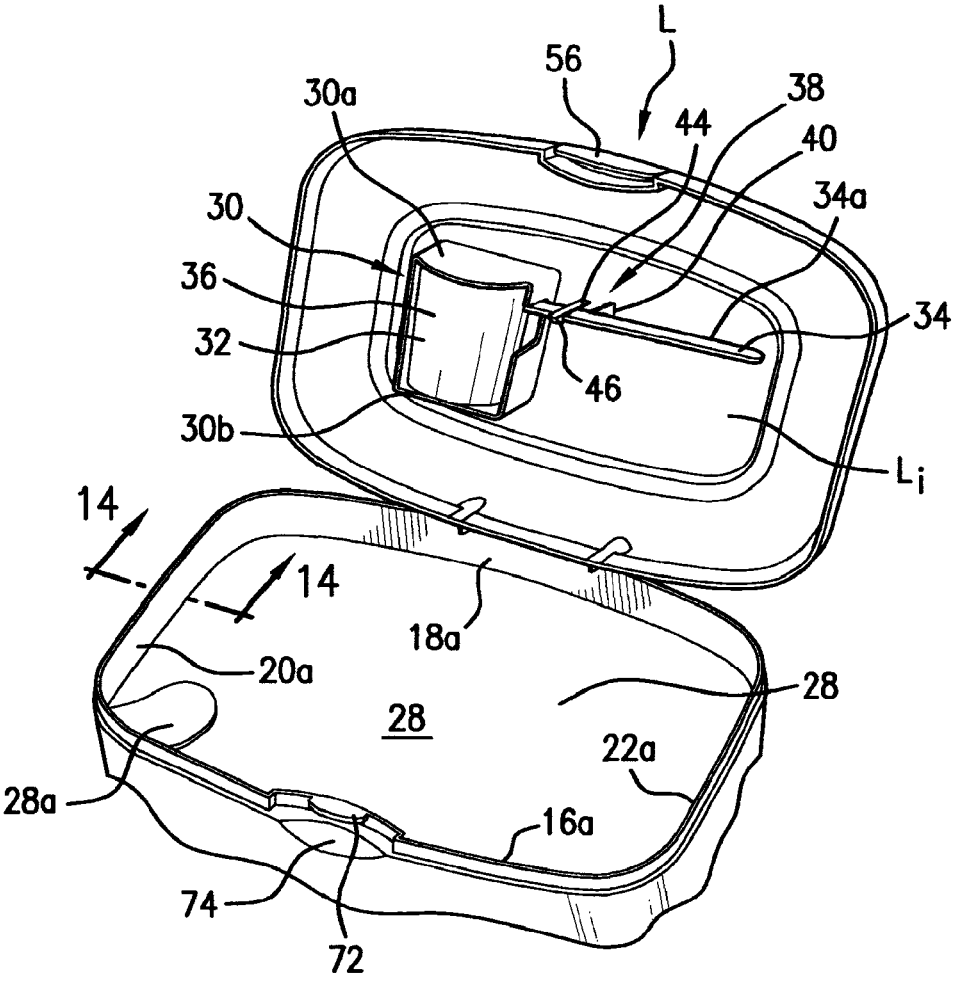

FIG. 13 is a perspective view of the lid attached to the collar. This figure shows the interior surface of the lid incorporating an attached scoop holder and a restraint and standoff bracket for the handle of the scoop. This figure further shows a substantially moisture-impervious, oxygen-impervious seal attached to the rim or sealing flange of the tub-shaped receptacle.

Figure 14:
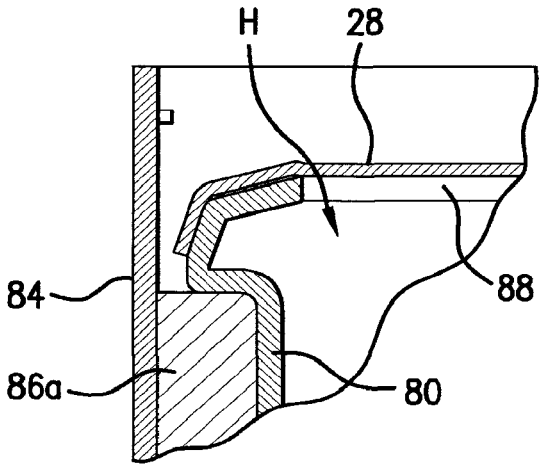

FIG. 14 is cross-sectional view taken along line 14-14 in FIG. 13. This figure illustrates attachment of the substantially moisture-impervious, oxygen-impervious seal to the rim of the tub-shaped receptacle.

Figure 15:
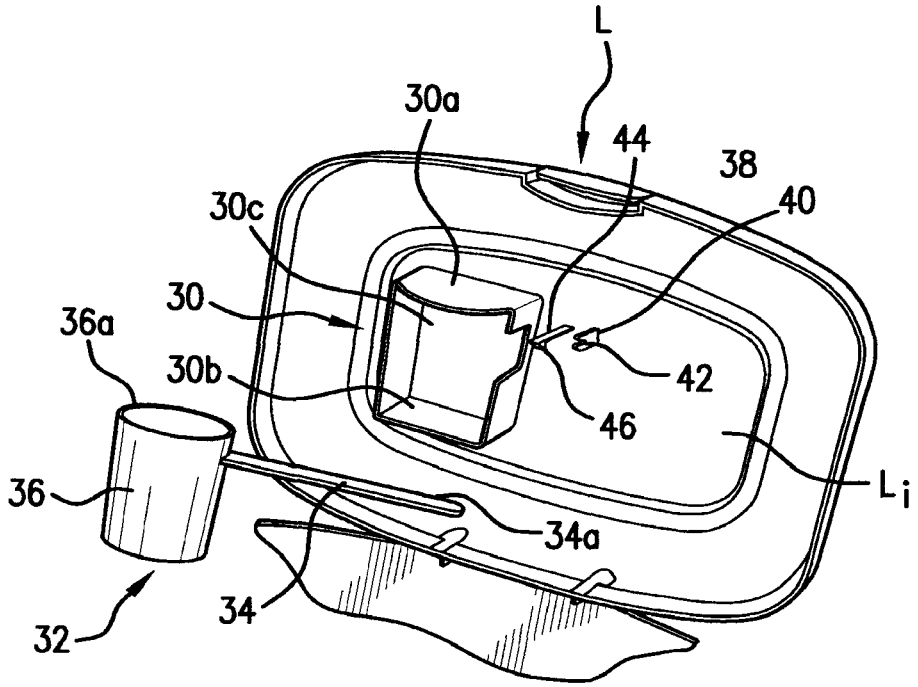

FIG. 15 is an exploded perspective view of the interior surface of the lid showing the scoop removed from the scoop holder and the restraint for the handle of the scoop.

Figure 16:
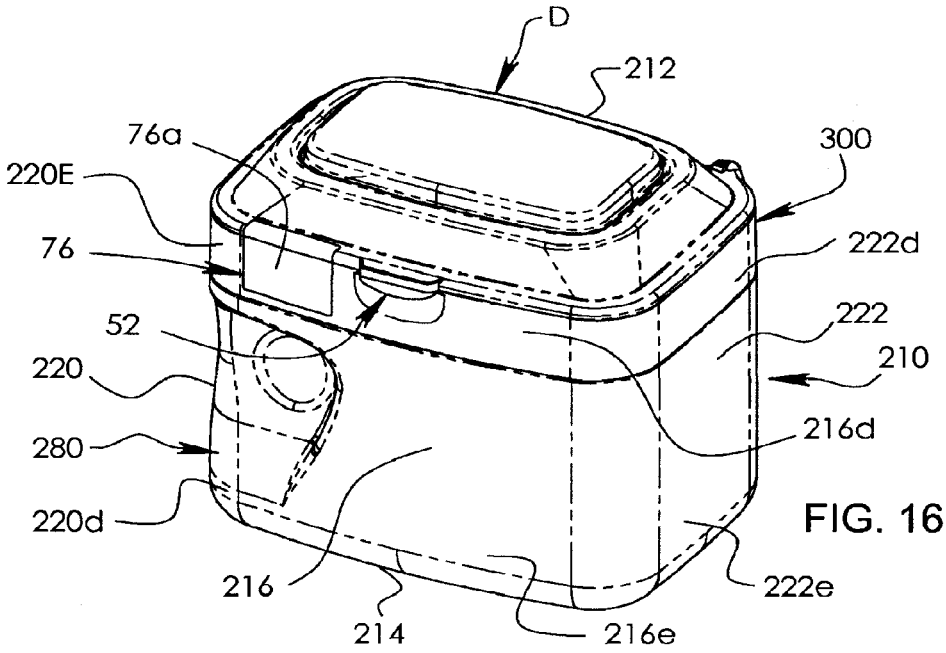

FIG. 16 is a perspective view of another embodiment of the container described herein. In this figure, the container lid is closed and a side of the container includes grip features.

Figure 1:
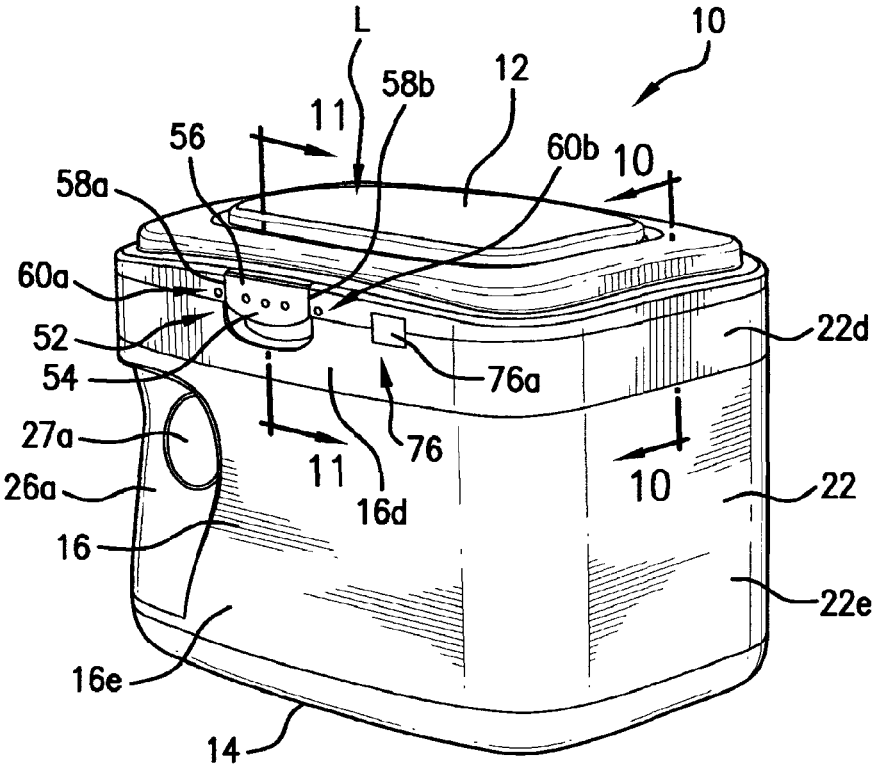
Figure 17:
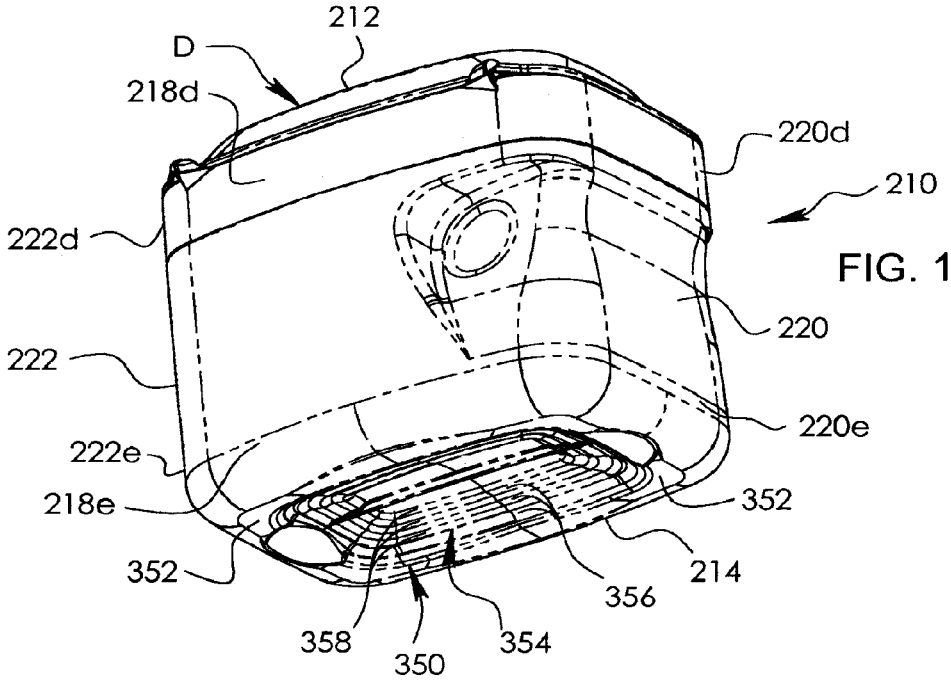

FIG. 17 is a perspective view of the embodiment of the container of FIG. 16, and rotated to show rear and bottom sides of the container that are not shown in FIG. 1.

Figure 18:
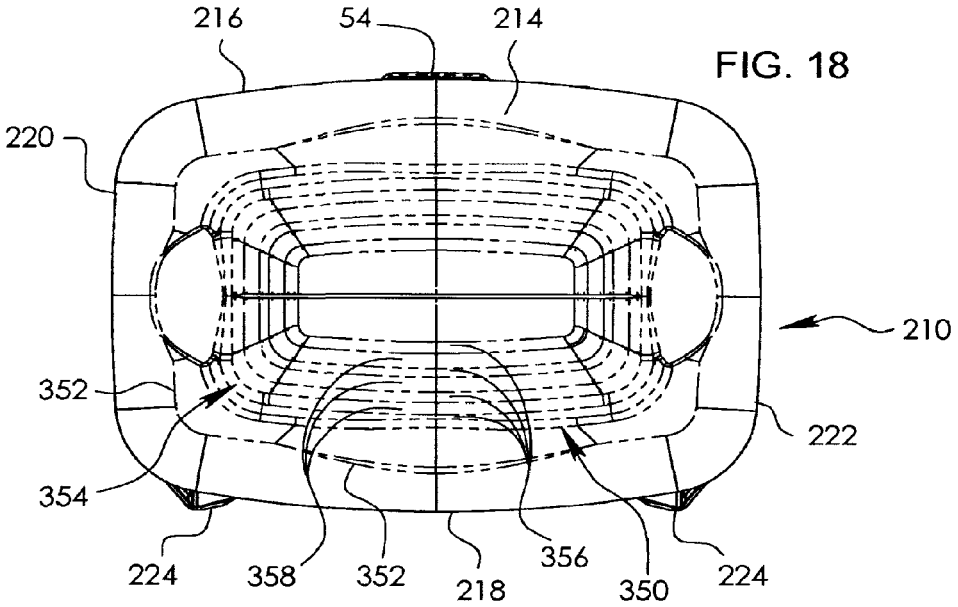

FIG. 18 is a bottom plan view of the embodiment of the container of FIGS. 16 and 17 showing features of the bottom wall of the container that include stepped pressure compensating riser and tread features.

Figure 19:
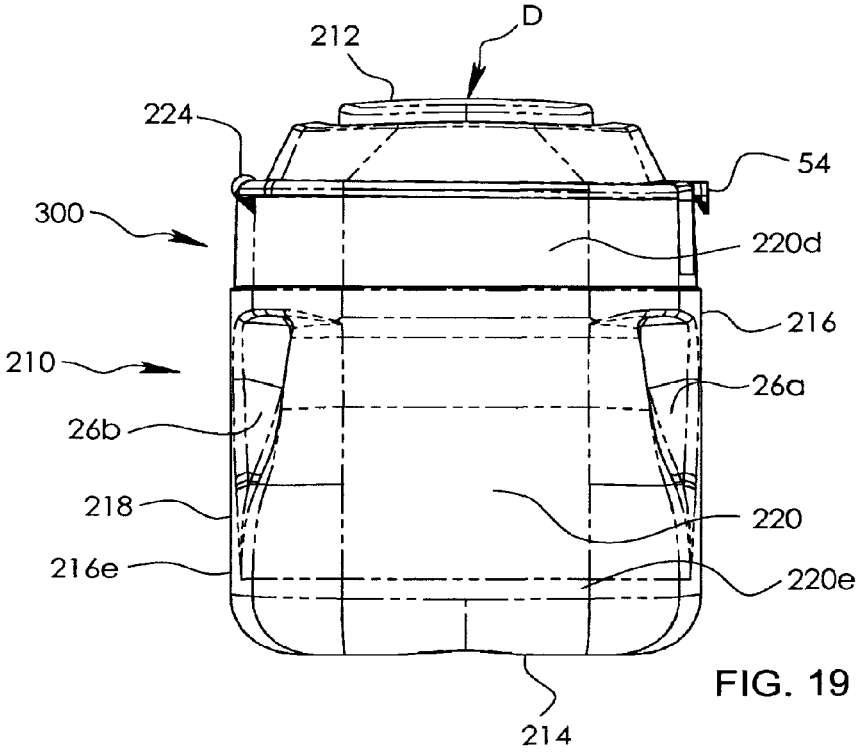

FIG. 19 is an elevation view of a first side wall of the embodiment of the container of FIG. 16 showing the front and rear gripping features.

Figure 20:
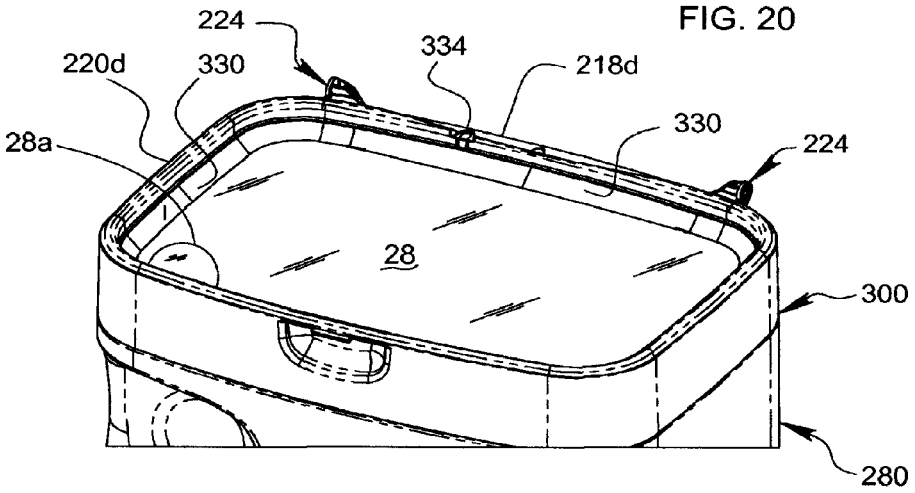

FIG. 20 is a partial perspective view of the embodiment of the container of FIG. 16 having the lid removed for purposes of illustrating the collar and the arrangement of the impervious seal affixed and covering the opening of the container.

Figure 21:
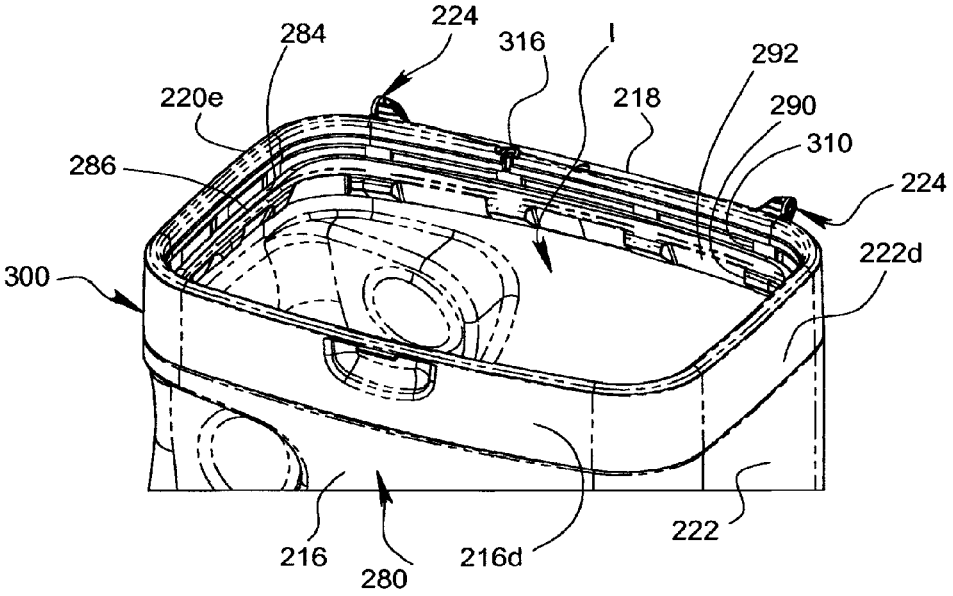
Figure 23:
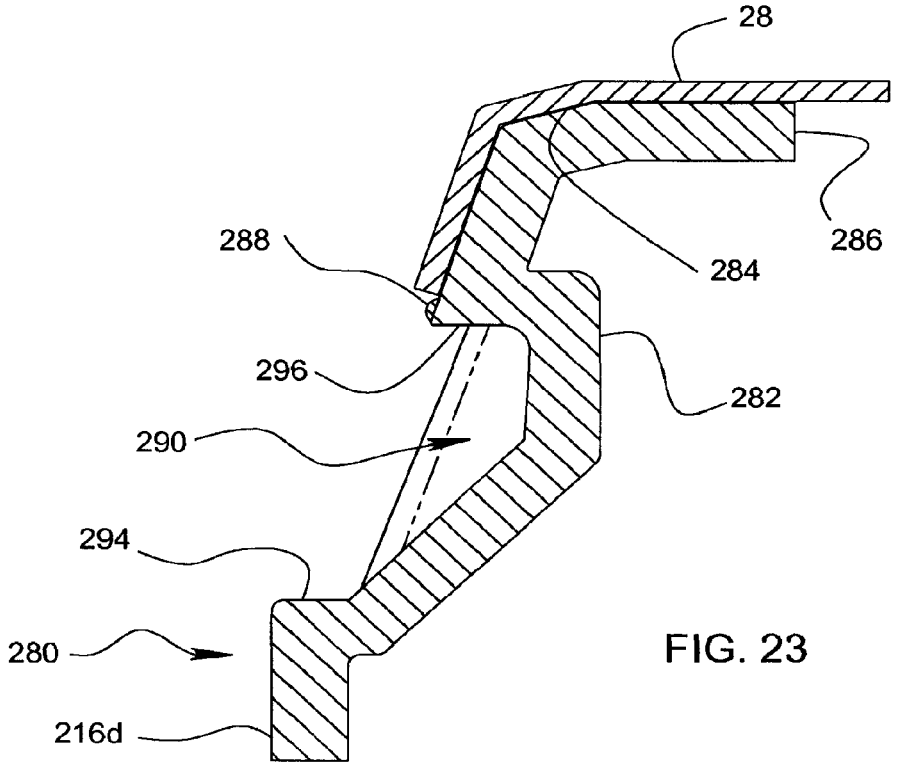

FIG. 21 is another partial perspective view of the embodiment of the container of FIG. 23 also having the gasket and impervious seal removed to illustrate the collar as it is retained on the tub shaped receptacle of the container.

Figure 22:
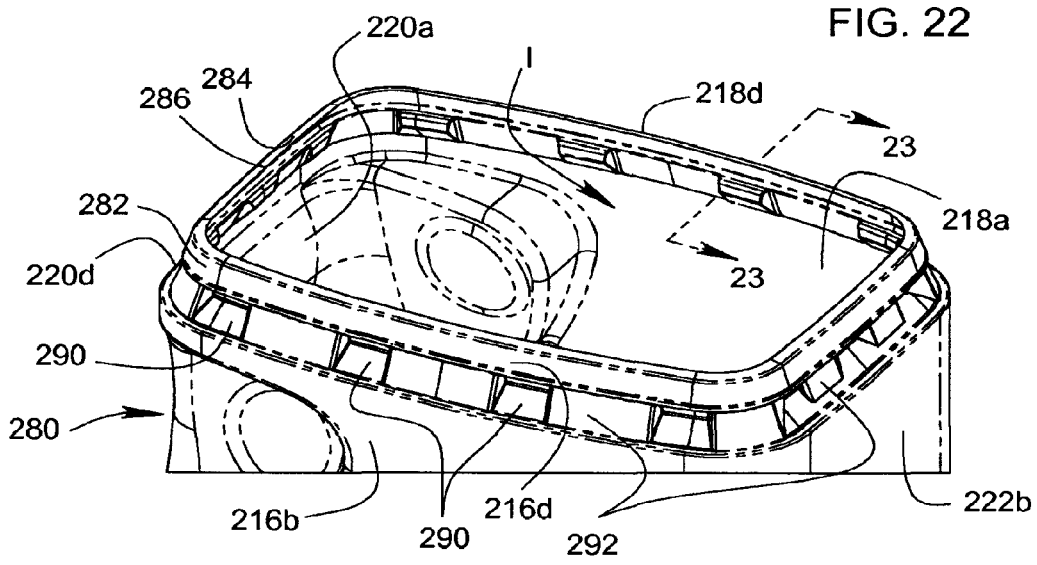

FIG. 22 is a partial perspective view of the embodiments of the container shown in FIGS. 20 and 21 having the collar and the impervious seal removed to show the collar engagement features of the upper portion of the receptacle.

FIG. 23 is a cross-section view of the upper end and sealing flange of the tub-shaped receptacle of the embodiment of the container of FIGS. 20-22, which is taken along section line 23-23 of FIG. 22. The impervious seal has been added for improved illustration purposes.

FIG. 24 is a perspective view of the collar of the embodiments of the container of FIGS. 16-22.

FIG. 25 is a cross-section view of the collar of the embodiment of the container shown in FIG. 24 and taken along section line 25-25.

Figure 26:
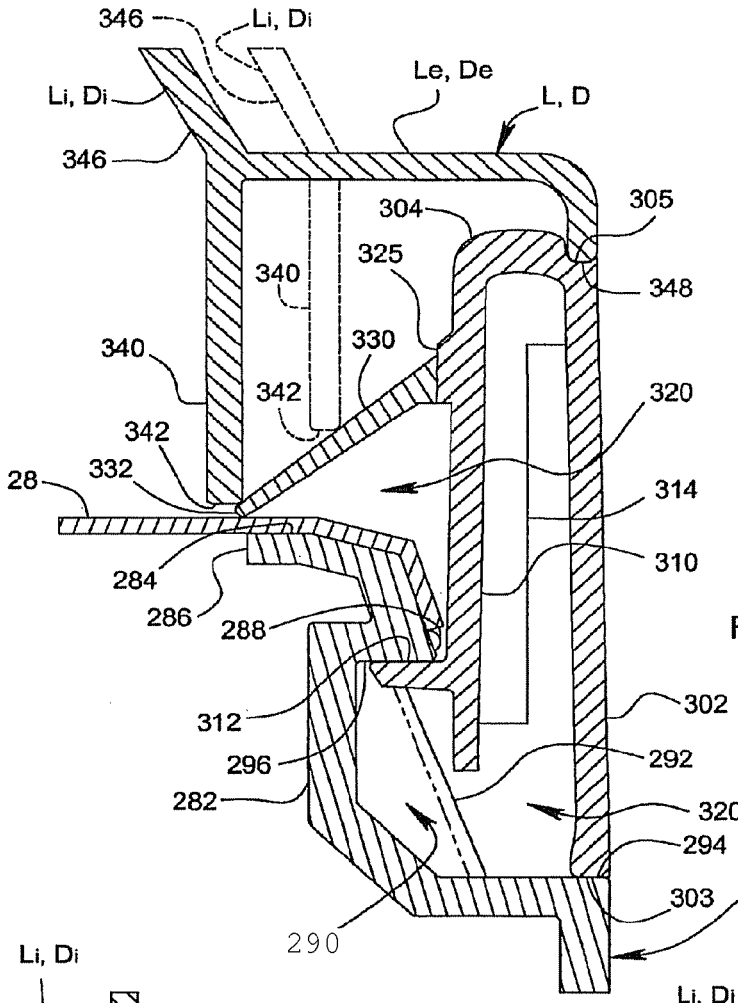

FIG. 26 is a cross-section view of the collar of the embodiment of the container shown in FIGS. 16-22 and taken along section line 26-26 of FIG. 24, but having certain additional lid structure shown for illustration purposes.

Figure 27:
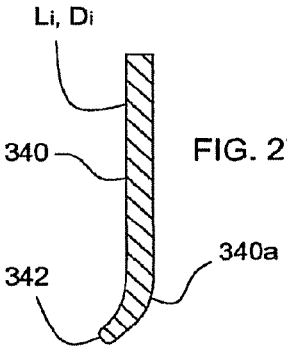

FIG. 27 is a cross-sectional view of an alternative variation of the sealing wall illustrated in FIG. 26.

Figure 28:
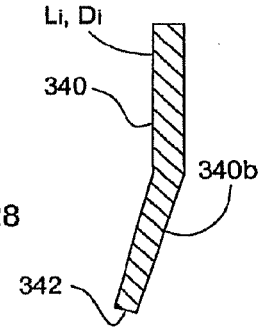

FIG. 28 is a cross-sectional view of another alternative variation of the sealing wall illustrated in FIG. 26.

Figure 29:
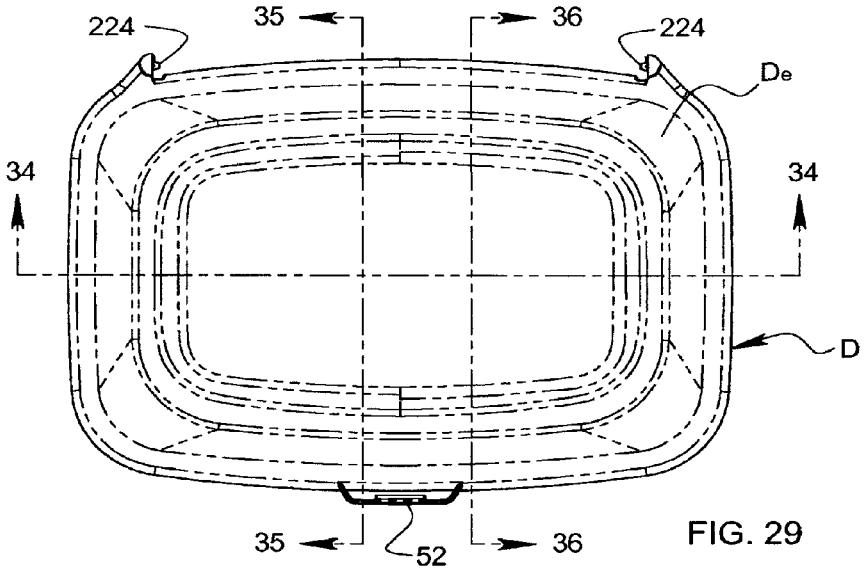

FIG. 29 is a top plan view of the embodiment of the container of FIGS. 16-19 showing the top wall including the lid and cover assembly.

Figure 30:
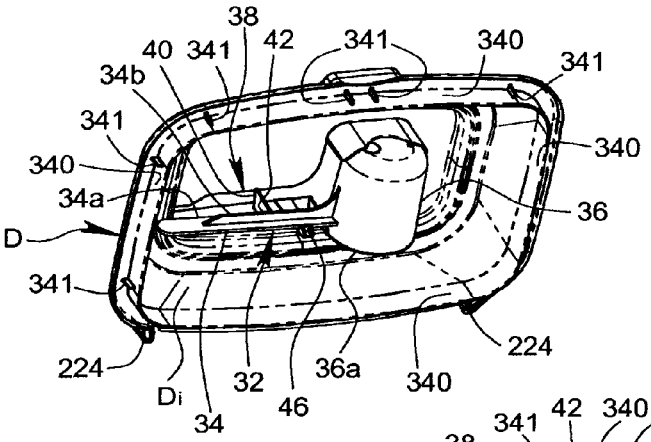

FIG. 30 is a perspective view of the underside of the lid of the embodiment of the container of FIGS. 16-19 and illustrating a scoop holder retaining a scoop.

Figure 31:
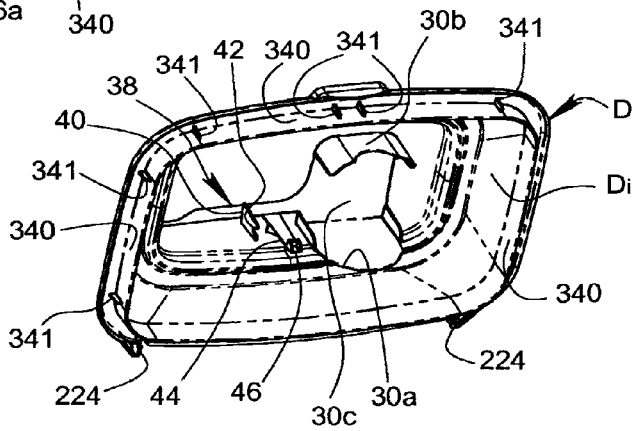

FIG. 31 is a perspective view of the underside of the lid of FIG. 30 having the scoop removed for further illustration of the scoop holder.

Figure 32:
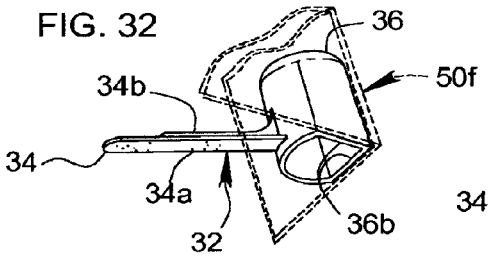
Figure 33:
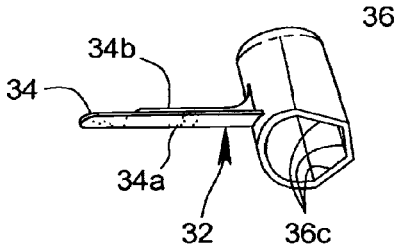

FIGS. 32 and 33 are perspective views of the scoop in different orientations to show alternative variations of the congruent rim of the bowl of the scoop.

Figure 34:
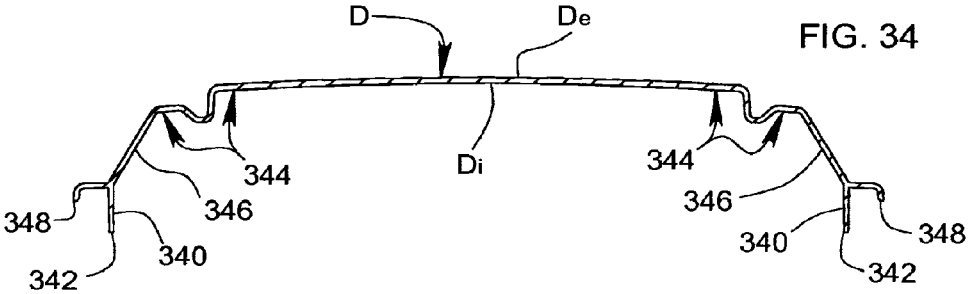

FIG. 34 is a section view of the lid of the embodiment of the container of FIG. 29 and taken along section line 34-34 to show a laterally extending cross section of the domed and angled wall lid variation.

Figure 35:
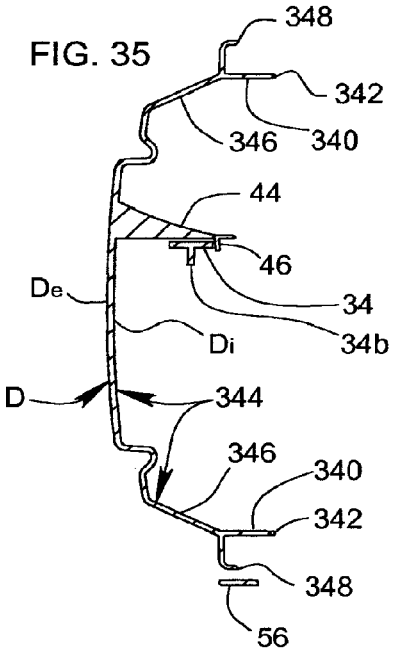

FIG. 35 is a section view of the lid of the embodiment of the container of FIG. 29 and taken along section line 35-35 with a view directed towards retainer elements of the scoop holder.

Figure 36:
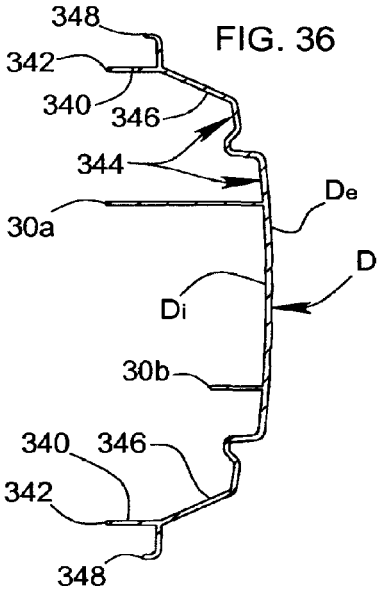

FIG. 36 is a section view of the lid of the embodiment of the container of FIG. 29 and taken along section line 36-36 with a view directed towards the scoop holder bowl brackets.

FIG. 37 is a section view of the embodiment of the container of FIG. 18, and taken along section line 37-37, which depicts the bottom pressure control, centralized stiffener, and/or stepped portion modification to the bottom of the receptacle.

FIGS. 38*a* and 38*b* are detail views taken about detail view lines 38 in FIG. 37 and illustrate alternative flexible and pressure responsive, decreased thickness cross-sectional configurations of the centralized stiffener or stepped portion of the bottom of the receptacle.

FIGS. 39*a* and 39*b* are detail views taken about detail view lines 39 in FIG. 37 and illustrate another alternative flexible and pressure responsive, bellows and/or pleated cross-sectional configuration of the centralized stiffener or stepped portion of the bottom of the receptacle.

DETAILED DESCRIPTION OF CERTAIN EMBODIMENTS AND VARIATIONS

As used herein, the expression "top wall" means the side of the container exclusive of the bottom wall, the first side wall, the second side wall, the front wall, and the rear wall of the container. The term "lid" means a hinged cover for a hollow receptacle and is intended to include either an independently formed and removable lid and other variations that can include the lid alone, the lid and collar assembly, and other variations wherein the lid and/or collar are formed from the top wall of the container plus the upper portion of the first side wall, the upper portion of the second side wall, the upper portion of the front wall, and the upper portion of the rear wall of the container. As used herein, the term "bracket" means a wall-anchored fixture adapted to support a load.

Referring now to FIGS. 1, 2, and 5-9, a container 10 includes a top wall 12, a bottom wall 14 with an interior bottom surface 14*a*, a front wall 16, a rear wall 18, a first side wall 20, a second side wall 22. The front wall 16 comprises an interior major surface 16*a*, an exterior major surface 16*b*, an upper portion 16*d*, and a lower portion 16*e*. The rear wall 18 comprises an interior major surface 18*a*, an exterior major surface 18*b*, an upper portion 18*d*, and a lower portion 18*e*. The first side wall 20 comprises an interior major surface 20*a*, an exterior major surface 20*b*, an upper portion 20*d*, and a lower portion 20*e*. The second side wall 22 comprises an interior major surface 22*a*, an exterior major surface 22*b*, an upper portion 22*d*, and a lower portion 22*e*.

Although the container 10 and the later described variations and modifications thereto are illustrated in the various descriptions and figures to be substantially cuboid, a cuboid shape is depicted only because such a shape is sometimes found by those skilled in the relevant arts to be the more challenging type of container to describe, manufacture, and to use. However, the present invention is susceptible for use with all shapes and sizes of containers including cylindrical, obloid, rectilinear, and other shapes, and for use with containers adapted for fluids as well as for the powdered materials and/or product described most often herein. Furthermore, each of the optional and preferred embodiments of the invention contemplate interchangeability with all of the various features, components, modifications, and variations illustrated throughout the written description and pictorial illustrations.

Figure 2:
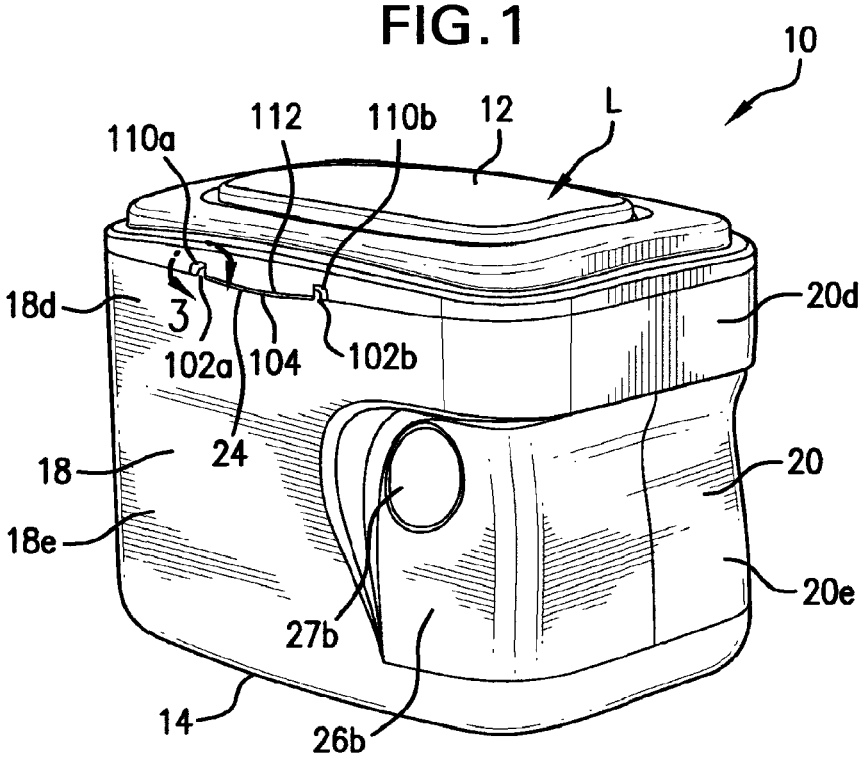
FIG. 2 is a perspective view of the embodiment of the container shown in FIG. 1 that depicts sides of the container not shown in FIG. 1 and a side of the container having a grip feature.
Figure 4:
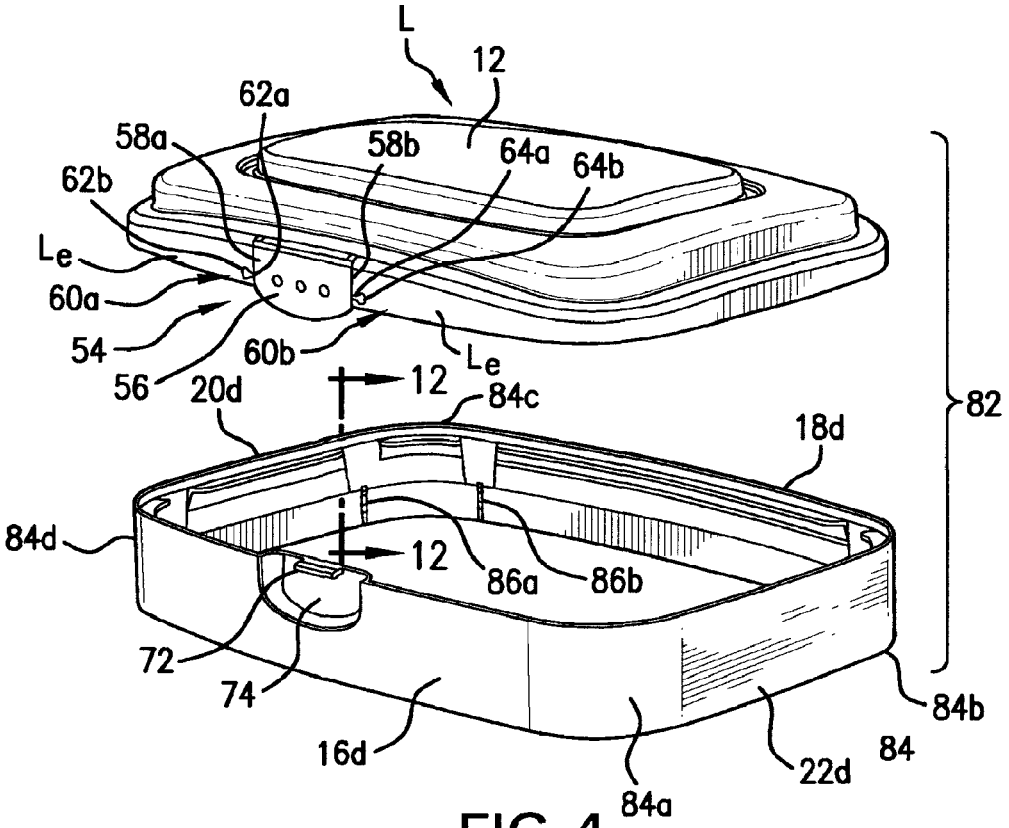
FIG. 4 is an exploded perspective view of an assembly comprising a collar and a lid. The assembly of the collar and the lid can be applied to a tub-shaped receptacle to form the container described herein.
Figure 5:
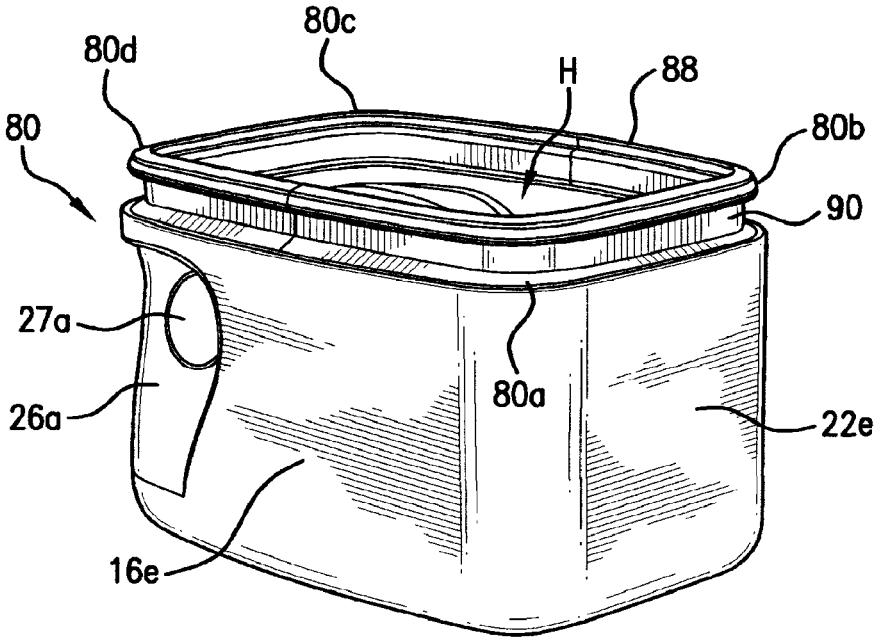
FIG. 5 is a perspective view of a tub-shaped receptacle to which the assembly comprising the collar and the lid, shown in FIG. 4, can be applied to form the container described herein.
Figure 6:
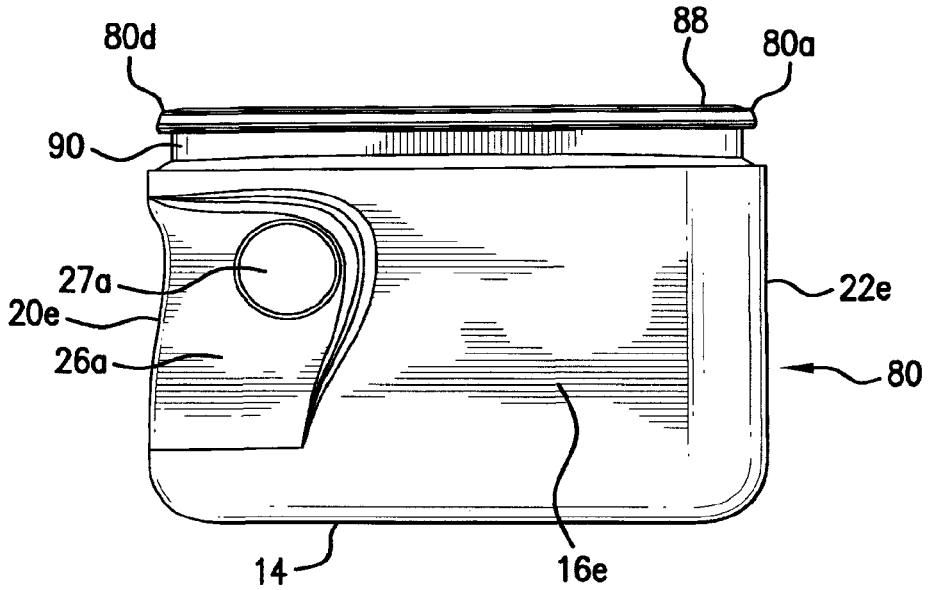
FIG. 6 is a side view in elevation of the embodiment of the container shown in FIG. 1. This figure shows the front wall of the container, which has a grip feature.
Figure 7:
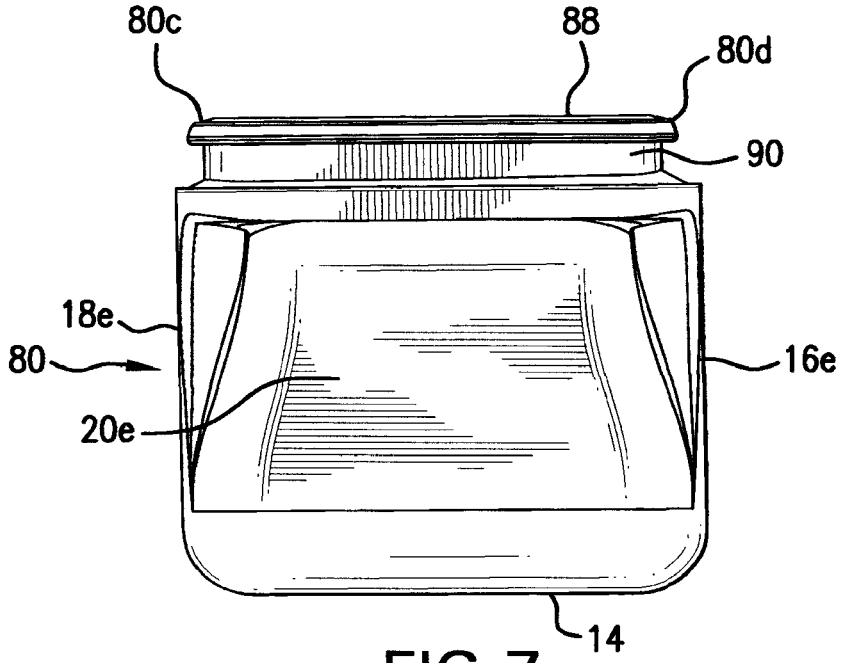
FIG. 7 is an end view in elevation of the embodiment of the container shown in FIG. 1. This figure shows the first side wall of the container, which is adjacent to the grip features of the front wall and the rear wall of the container.
Figure 8:
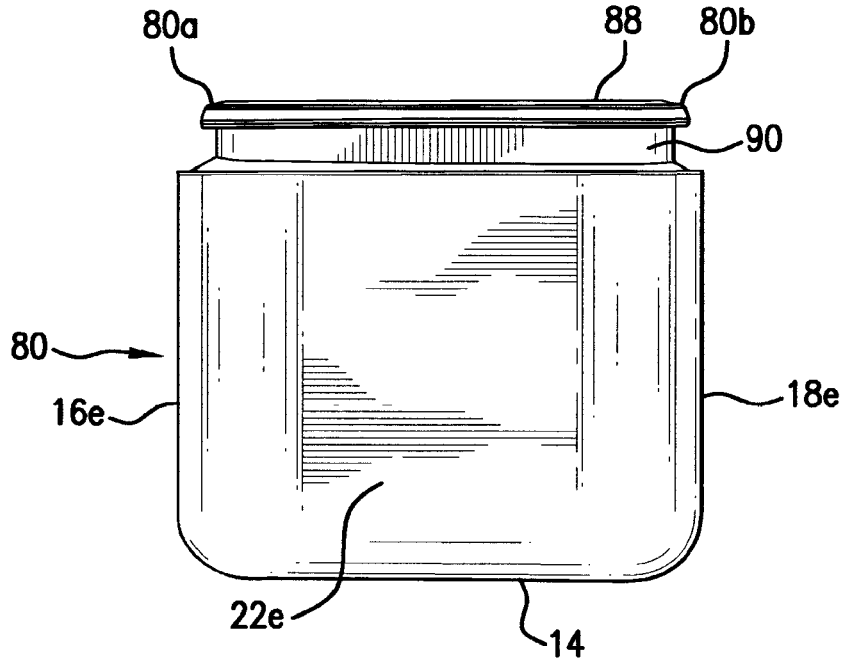
FIG. 8 is an end view in elevation of the embodiment of the container shown in FIG. 1. This figure shows the second side wall of the container, which is not adjacent to the grip features of the front wall and the rear wall of the container.

As can be seen in FIGS. 1, 2, and 4, in an exemplary embodiment of the invention, an assembly of a lid and a collar of the container 10, which are discussed here and in the context of other variations elsewhere herein, is formed from and/or includes a part of the top wall 12 and the upper portion 16*d* of the front wall 16, the upper portion 18*d* of the rear wall 18, the upper portion 20*d* of the first side wall 20, and the upper portion 22*d* of the second side wall 22. The lid and the collar variations contemplated here may be formed integrally with the walls, may be formed as an integral lid and collar assembly and/or combination, and may also be provided as a separate lid and a separate collar that can be joined with a hinge or another type of pivotally and/or removable device or connection to one or more portions of the walls. As will be described in more detail below, the lid and collar arrangements can be attached and assembled to the inventive containers in a variety of ways including clips, friction-fit configurations, and using other equally desirable and optional components and methods.

The lid is also described in more detail below in connection with the various embodiments of the invention and will hereinafter be referred to by the reference characters "L" and "D" (see FIGS. 1, 2, 4, and 29-31) to refer to the various embodiments and variations thereof. Focusing initially on the lid "L" of the version illustrated in FIGS. 1, 2, and 4, lid "L" has an interior surface, which will hereinafter be referred to by the reference character "Li". The lid also has an exterior surface, which will hereinafter be designated by the reference character "Le". A hinge 24 attaches the lid "L" to the rear wall 18.

The front wall 16 has a recess 26*a* positioned to facilitate gripping of the container 10 by the left thumb of the user. The rear wall 18 also has a recess 26*b* positioned to facilitate gripping of the container 10 by the fingers of the left hand of the user. The recess 26*a* can further have an additional recess 27*a* to indicate the precise location in the recess 26*a* for the placement of the thumb of the user. The recess 27*a* is smaller in area than the recess 26*a*. The recess 27*a* is preferably circular in shape, but other shapes are also acceptable. The recess 26*b* can further have an additional recess 27*b* to indicate the precise location in the recess 26*b* for the placement of the desired finger of the user. The recess 27*b* is smaller in area than the recess 26*b*. The recess 27*b* is preferably circular in shape, but other shapes are also acceptable. The recesses 26*a* and 26*b* are positioned adjacent to the first side wall 20 of the container 10.

In an alternative embodiment (not shown), the recesses 26*a*, 27*a*, 26*b*, and 27*b* can be positioned to facilitate gripping of the container 10 by the right thumb of the user and by the fingers of the right hand of the user. In this alternative embodiment, the recesses would be positioned adjacent to the second side wall 22 of the container 10.

In still another alternative (not shown), the front wall 16 can have two recesses and the rear wall 18 can have two recesses, one recess on the front wall 16 and one recess on the rear wall 18 positioned to facilitate gripping of the container 10 by the left thumb and the fingers of the left hand of the user and one recess on the front wall 16 and one recess on the rear wall 18 positioned to facilitate gripping of the container 10 by the right thumb and the fingers of the right hand of the user. In this embodiment, pairs of recesses would be positioned adjacent to both the first side wall 20 and the second side wall 22.

The hinge 24 prevents the lid "L" from descending when the product is being accessed by the user, which would cause a nearly empty container to tip over. The hinge 24 can be a living hinge or a conventional mechanical hinge. A living hinge is a thin flexible web of material that joins two rigid bodies together. In this case, the living hinge connects two segments of an object, i.e., the lid "L" and the rear wall 18 of the container 10, to keep the segments together and allow the object to be opened and closed.

The material used to make a living hinge is preferably a very flexible polymeric material, such as, for example, polypropylene and polyethylene. Living hinges can be flexed numerous times without failure. Living hinges are described in more detail at http://www.efunda.com/designstandards/plastic_design/hinge.cfm, Nov. 6, 2006, pages 1-3 and at http://engr.bd.psu.edu/pkoch/plasticdesign/living_hinge.htm, Nov. 6, 2006, pages 1-8.

Conventional mechanical hinges include, but are not limited to, hinge assemblies comprising a first panel having two or more sockets mounted on an edge thereof and a second panel having two or more pins mounted on an edge thereof, the aforementioned pins mating with the aforementioned sockets to join the edge of the first panel to the edge of the second panel, the pins and the sockets allowing rotation of the first panel about the second panel. Conventional mechanical hinges are described in more detail in http://www.hardwaresource.com/index.asp, see "other hinges", Dec. 26, 2006.

The hinge 24 is designed in such a manner that when the lid "L" of the container 10 is opened to enable the user to obtain access to the contents of the container 10, the lid "L" will not fall forward to the closed position. Further, the lid "L" will not fall too far backward beyond the open position desired, which would cause a container 10, when nearly empty, to tip over onto the rear wall 18. Another type of equally suitable mechanical hinge can be seen with reference to FIGS. 16-21, 24, and 29-31, among other figures and description discussed elsewhere herein.

The top wall 12, the bottom wall 14, the front wall 16, the rear wall 18, the first side wall 20, and the second side wall 22 enclose a hollow interior space "H" (FIGS. 5, 9) into which a product can be inserted. While the hollow interior space "H" can hold any solid or liquid product, the particular product for which the container 10 is designed is typically a flowable solid material, such as, for example, a powdered product and/or a granular product. Representative examples of such a powdered product or granular product include, but are not limited to, infant formula, flour, coffee, and sugar.

Referring now to FIGS. 13, 14, 20, 23, and 26, a substantially moisture-impervious, oxygen-impervious seal 28 is attached to the interior major surfaces 16*a*, 18*a*, 20*a*, 22*a* of the front wall 16, the rear wall 18, the first side wall 20, and the second side wall 22, respectively. Optionally, the substantially moisture-impervious, oxygen-impervious seal 28 can also be impervious to light. A pull-tab 28*a* on the substantially moisture-impervious, oxygen-impervious seal 28 can be used to facilitate removal of the seal 28 by the user.

The substantially moisture-impervious, oxygen-impervious seal 28 can be formed from a sheet of material substantially impervious to oxygen, moisture, and light. A material suitable for use in preparing the substantially moisture-impervious, oxygen-impervious seal 28 can be a sheet of foil, such as, for example, aluminum foil, or a foil made of some other metallic material, or a combination of a layer of materials that can include a metallic, a polymeric, and other material layers.

In one embodiment, the substantially moisture-impervious, oxygen-impervious seal 28 be applied at a position near the edges of the upper portion 16*d* of the front wall 16, the upper portion 18*d* of the rear wall 18, the upper portion 20*d* of the first side wall 20, and the upper portion 22*d* of the second side wall 22 on the interior major surfaces 16*a*, 18*a*, 20*a*, 22*a*, of the front wall 16, the rear wall 18, the first side wall 20, and the second side wall 22, respectively, of the container 10. The substantially moisture-impervious, oxygen-impervious seal 28 can be removed by pulling the pull-tab 28*a* of the seal 28 and removing the seal 28 from the positions of attachment to the interior major surfaces 16*a*, 18*a*, 20*a*, 22*a*, of the front wall 16, the rear wall 18, the first side wall 20, and the second side wall 22, respectively, of the container 10.

Referring now to FIGS. 13, 15, 30-31, 35, and 36, attached to the interior surface "$L_i$" of the lid "L" (and an interior surface "$D_i$" of later described lid "D") is a scoop holder 30. The scoop holder 30 comprises a first bracket 30*a* and a second bracket 30*b*. The scoop holder 30 is capable of retaining a scoop 32 in such a position so as to be separated from the product. The scoop 32 comprises a handle 34 attached to a bowl 36 wherein the handle may incorporate a stiffener 34*b* (FIGS. 330, 32-33). Other variations of equally preferred and optionally desirable scoops 30 are discussed below and can be seen with reference to FIGS. 30, 32, and 33, and in other places elsewhere herein.

The scoop 32 is positioned in the first bracket 30*a* and the second bracket 30*b* in such a manner that the user is induced to remove the scoop 32 by the handle 34, rather than by the bowl 36. Furthermore, the first bracket 30*a* and the second bracket 30*b* are positioned so that the scoop 32 is held by the first bracket 30*a* and the second bracket 30*b* in such a manner as to prevent the powdered product or granular product from entering the bowl 36 of the scoop 32.

As discussed elsewhere, this feature is of particular benefit to users of the containers of the invention in view of the fact that such containers are subjected to unpredictable amounts of jostling, shaking, upside-down or inverted shipment by truck, car, and mail carrier, and impacts during manufacture, distribution, and daily use by consumers. Such a container is possibly subject to a higher level of abuse in environments involving children and child care, such as where a parent carries a powdered product in a container such as those described herein in an automobile and/or in a heavily-used diaper bag, both of which can experience the ravaging abuse of curious children at play.

The first bracket 30*a* of the scoop holder 30 covers the opening in the bowl 36 of the scoop 32, thereby preventing the product in the container from entering the bowl 36 of the scoop 32, which could lead to scattering product outside of the container upon removal of the scoop 32 from the scoop holder 30. The bowl 36 of the scoop 32 does not interfere with substantially moisture-impervious, oxygen-impervious seal 28 when the scoop 32 is positioned in the scoop holder 30.

The scoop holder 30 is positioned in such a manner that the handle 34 of the scoop 32 is prevented from contacting the substantially moisture-impervious, oxygen-impervious seal 28 positioned over the contents of the container, thereby protecting the integrity of the seal 28. In addition, the scoop holder 30 prevents the handle 34 from being dislodged and maintains the position of the scoop 32 during shipping and storage.

As shown in FIGS. 13 and 15, the scoop 32 can be inserted into the scoop holder 30 by sliding the bowl 36 of the scoop 32 into the opening 30*c* between the first bracket 30*a* and the second bracket 30*b*. When inserted into the scoop holder 30, the scoop 32 is retained by the first bracket 30*a* and the second bracket 30*b* by means of a friction fit.

The scoop 32 can be attached to the lid "L" by aligning the bowl 36 of the scoop 32 with the first bracket 30*a* and the second bracket 30*b* of the scoop holder 30 and sliding the bowl 36 of the scoop 32 against the first bracket 30*a* and the second bracket 30*b* of the scoop holder 30, thereby generating a friction fit between the bowl 36 of the scoop 32 and the scoop holder 30.

An optional, but desirable, feature of the lid "L" is a restraint 38 for preventing the handle 34 of the scoop 32 from rotating if the connection (i.e., the friction fit) between the scoop holder 30 and the bowl 36 of the scoop 32 loosens sufficiently to allow the bowl 36 of the scoop 32 to rotate in the scoop holder 30, thereby allowing the handle 34 of the scoop 32 to contact the substantially moisture-impervious, oxygen-impervious seal 28 and possibly puncture the seal 28.

As shown in FIGS. 13, 15, and 30-31, the aforementioned restraint 38 comprises a first projection 40 rising upwardly from the interior surface "Li" of the lid "L" and having a notch 42 at one end thereof for receiving an edge 34*a* of the handle 34 of the scoop 32. The aforementioned restraint 38 further comprises a second projection 44 positioned between the scoop holder 30 and the first projection 40 and rising upwardly from the interior surface "Li" of the lid "L". The second projection 44, which is of greater length than the first projection 40, has a keeper 46 formed at one end thereof to prevent the handle 34 of the scoop 32 from moving downwardly toward the substantially moisture-impervious, oxygen-impervious seal 28 if the bowl 36 of the scoop 32 rotates in the scoop holder 30.

The first projection 40 need not exhibit any level of flexibility, but the second projection 44 should be sufficiently flexible that it can be moved sufficiently by the handle 34 of the scoop 32 when the scoop 32 is being returned to the scoop holder 30 and the restraint 38. As can be understood with continued reference to FIGS. 15, 30, and 31, the upwardly rising first projection 40 cooperates with the second projection and restraint 44 to releasably capture and hold the handle 34 of the scoop 32 at a distance above the interior surface "$L_i$" of the lid "L" (and, the interior surface "$D_i$" of the alternative lid "D"). In this way, the user can easily grasp the handle 34 because a grasping position is maintained to enable convenient removal by a user, which is illustrating in FIGS. 15, 30, and 31, among other places. The handle is maintained at a stand-off distance in the grasp position, which is established by the height of first projection 40 between the handle 34 and the interior surfaces "$L_i$" and "$D_i$".

Figure 9:
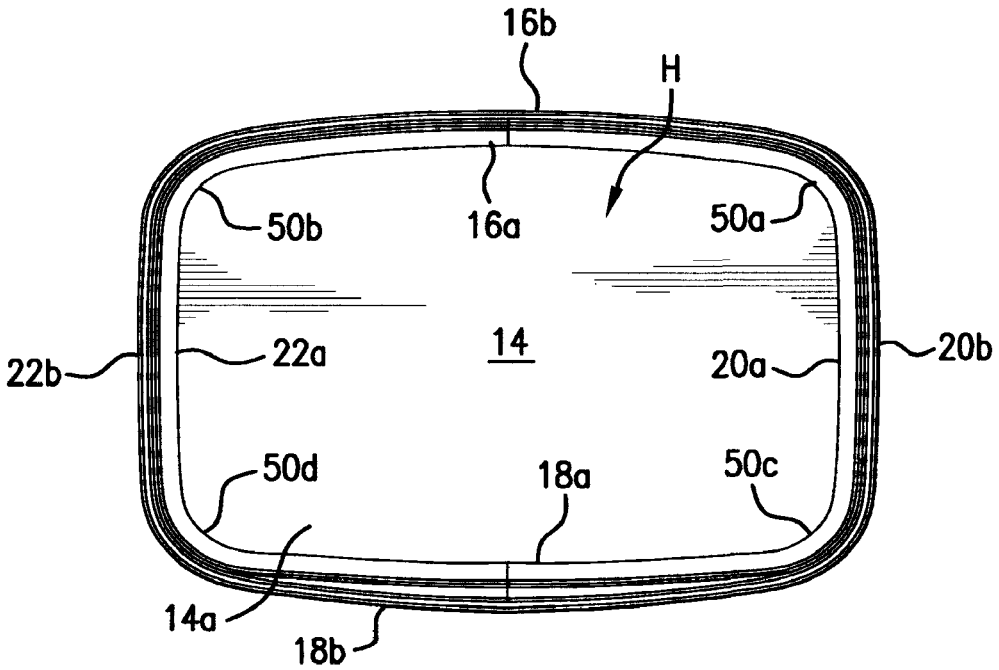
FIG. 9 is a top plan view of the interior of the embodiment of the container shown in FIG. 1. In this figure, the lid is removed from the container.
Figure 10:
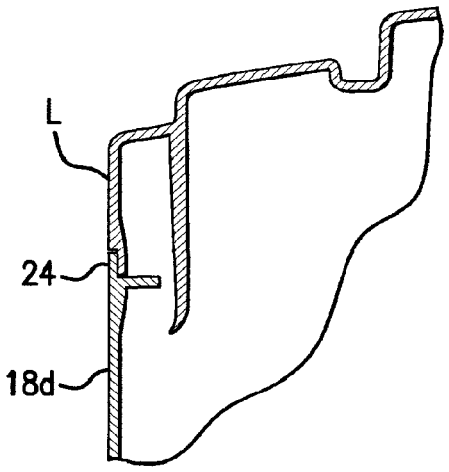
FIG. 10 is a cross-sectional view taken along line 10-10 in FIG. 1. This figure illustrates the lid attached to the collar by means of a living hinge to form an assembly thereof.

The bowl 36 of the scoop 32 has a rim 36*a* with a cross-sectional geometry that is shaped to be congruent with the junctions or corners 50*a*, 50*b*, 50*c*, and 50*d*, formed by the junctions between the front wall 16 and the first side wall 20 and the bottom wall 14, the front wall 16 and the second side wall 22 and the bottom wall 14, the rear wall 18 and the first side wall 20 and the bottom wall 14, and the rear wall 18 and the second side wall 22 and the bottom wall 14, respectively. The corners or junctions 50*a*, 50*b*, 50*c*, and 50*d* are shown in FIG. 9 and are also evident from the exterior views of FIGS. 1, 2, and 5-8. The shape of the corners 50*a*, 50*b*, 50*c*, and 50*d* and the shape of the rim 36*a* of the bowl 36 of the scoop 32 enable the maximum quantity of product to be removed from the container 10 by the scoop 32, without having to invert or to turn the container 10 over to pour out the product.

As shown in FIG. 9, the corners 50*a*, 50*b*, 50*c*, and 50*d* have a particular cross-sectional geometry and are preferably rounded, and are more preferably formed with the radius of each corner 50*a*, 50*b*, 50*c*, and 50*d* being approximately equal to the radius of the rim 36*a* of the bowl 36 of the scoop 32. In an alternative embodiment (FIG. 32, corner 50*f*), the corners can have other shapes, e.g., the corners 50*a*, 50*b*, 50*c*, and 50*d* and the corners or junctions between the bottom wall 14 and the walls 16, 18, 20, and 22 can meet to form right angles. The rim 36*a* of the bowl 36 can be formed with a portion of the rim having a right angle (see, e.g., FIGS. 32 & 33) that is generally congruent to that of the contemplated right angles of the corners or junctions between the walls 16, 18, 20, and 22 themselves and between the bottom wall 14 and the walls 16, 18, 20, and 22.

In still another embodiment (see exemplary scoop variation in FIG. 33), the corners 50*a*, 50*b*, 50*c*, and 50*d* can have three sides, with two 120° angles forming each corner. In these alternative embodiments, the bowl 36 of the scoop 32 would have a shape and/or a rim portion 36*c* (FIG. 33) that would be congruent with the shape of each corner 50*a*, 50*b*, 50*c*, and 50*d*. See also, for example, the analogous variation of a right angle scoop rim and wall junction illustrated in FIG. 32. In further optional or preferred arrangements, the walls 16, 18, 20, 22 join the bottom wall 14 to also have the particular cross-section geometry and are also more preferably rounded, and are even more preferably formed with radius similar to that of each corner 50*a*, 50*b*, 50*c*, 50*d* to be approximately equal to the radius and/or to have a shape congruent to that of the bowl 36 of the scoop 32. In any of these illustrative embodiments, those skilled in the art may comprehend from the discussion elsewhere herein that the material used to form the container 10 and the scoop 32 and/or the bowl 36 of the scoop may be of a flexible polymeric material that can enable the rim 36*a* of the bowl 36 to flex and/or to deform either a small or a more generous amount. In this way the cross-sectional geometry of the rim 36*a* can, during use, be biased against the junctions or corners in a way whereby the rim 36*a* more readily conforms to the particular cross-sectional geometry to maximize the ease of removal of the contents from the hollow interior space "H". In FIGS. 32 and 33 examples of congruently shaped bowls 36 are shown. In FIG. 32, the rim has a portion 36*b* arranged to have a right angle that can conform to and be congruent with a corner 50*f* of a container having a similar right angled wall junction. In FIG. 33, the rim has a multi-angled rim 36*c* wherein multiple obtuse angles are formed to be congruent with a similarly shaped wall junction (not shown, but similar in concept to wall junction 50*f* of FIG. 32).

The shape of the bottom wall 14 of the container 10 and the shape of the top wall 12 of the container 10 can be designed to enable a plurality of containers 10 to be stacked, one upon another, such as, for example, on a shelf in a grocery store. It is preferred that the shape of the perimeter of the bottom wall 14 of the container 10 be substantially similar to the shape of the perimeter of the top wall 12 of the container 10. The top wall 12 can be flat or contoured and the bottom wall 14 can be flat or contoured. Generally, if the top wall 12 is contoured, the bottom wall 14 must also be contoured in such a manner as to be substantially congruent with the top wall 12, so that a plurality of containers 10 can be stacked one on top of another.

However, so long as the lid "L" is flat, the containers 10 will be stackable even if the bottom wall 14 of the container 10 is not flat, provided that the bottom wall 14 of the container 10 is designed so that the top wall 12 of the container 10 remains in a horizontal orientation relative to a horizontal shelf. In FIGS. 1, 2, 4, 10-12, and in FIGS. 16, 19, 30-31, and 34-36, it can be seen that the top wall 12 (or also top wall 212) of the container 10 (or the container 210) is convex in shape. Accordingly, for the embodiment shown in FIGS. 1 and 2, the bottom wall 14 of the container 10 is preferably concave in shape, so that a plurality of containers 10 can be stacked one upon another.

The rectangular shape of the container 10, in combination with the recesses 26*a* and 26*b* for gripping, enables the user to hold the container 10 with one hand, while using the scoop 32 with the other hand. The shape of the container 10 enables ease of access to the product during the act of removing the product from the container 10 by means of the scoop 32.

The shape of the container 10 enables the lid "L" to be securely fitted to the upper portions 16*d*, 18*d*, 20*d*, and 22*d*, of the front wall 16, the rear wall 18, the first side wall 20, and the second side wall 22, respectively, of the container 10.

Figure 11:
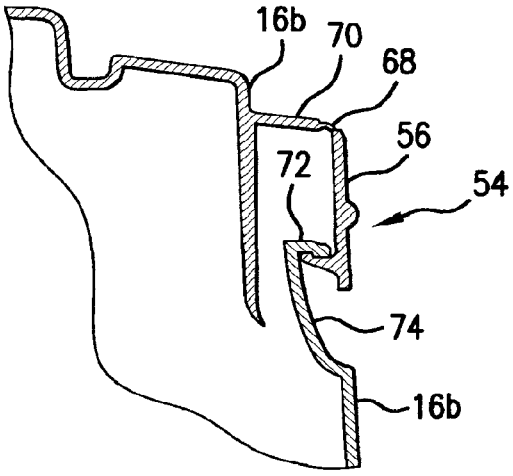
FIG. 11 is a cross-sectional view taken along line 11-11 in FIG. 1. This figure illustrates a latch that can be used to maintain the lid in a closed position.
Figure 12:
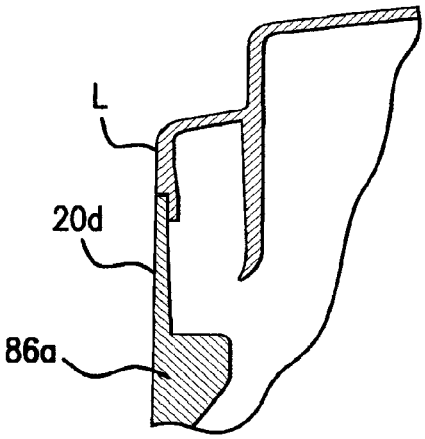
FIG. 12 is a cross-sectional view taken along line 12-12 in FIG. 4. This figure illustrates the lid attached to the collar of the assembly comprising the collar and the lid.

Referring now to FIGS. 1, 4, and 11, (and to FIGS. 16 and 19 for illustrations of later discussed embodiments and variations thereto) a container-locking feature 52 associated with the lid "L" and the front wall 16 enables the lid "L" to be securely, and robustly fitted to the edges of the upper portions 16*d*, 18*d*, 20*d*, and 22*d*, of the front wall 16, the rear wall 18, the first side wall 20, and the second side wall 22, respectively, of the container 10 over a range of the dimensional tolerances of the container 10. The container-locking feature 52 comprises a latch 54 having a tab or flap 56, a first edge 58*a* and a second edge 58*b*.

A first bridge 60*a* and a second bridge 60*b* project from the first edge 58*a* and the second edge 58*b* of the latch 54, respectively. The first bridge 60*a* comprises a small stem 62*a* at one end of which is a knob 62*b*; the second bridge 60*b* comprises a small stem 64*a* at one end of which is a knob 64*b*. The knobs 62*b* and 64*b* and portions of the small stems 62*a* and 64*a* fit into small recesses (not shown) in the exterior surface "Le" of the lid "L", which small recesses are congruent with the bridges 60*a* and 60*b*, and are prevented from being removed from the recesses (not shown) by friction, until the latch 54 is opened for the first time. The function of the bridges 60*a* and 60*b* is to indicate any tampering with the latch 54. Referring now to FIG. 11, the tab or flap 56 of the latch 54 is attached to the front wall 16 by a hinge 68, typically a living hinge, which connects the tab or flap 56 to an element 70 projecting from the exterior major surface 16*b* of the front wall 16.

When the latch 54 is in a non-tampered state, the first bridge 60*a* and the second bridge 60*b* retain their integrity. Prior to being used, the tab or flap 56 is maintained in a closed position by gripping a keeper 72, which is formed into a recessed portion 74 of the exterior major surface 16*b* of the front wall 16. When the latch 54 is opened by rotating the tab or flap 56 from its initial unopened position to a second position away from the keeper 72, the pull force breaks the small stems 62*a* and 64*a*, thereby allowing the lid "L" of the container 10 to be lifted upwardly so that the lid "L" can rotated about the hinge 24 (see FIG. 2) to enable the user to obtain access to the interior of the container 10.

If the user finds that extremely little pulling force is required to break the small stems 62*a* and 64*a* of the bridges 60*a* and 60*b*, respectively, the consumer will suspect that tampering with the latch 54 has taken place. After the small stems 62*a* and 64*a* are broken, the knobs 62*b* and 64*b* help to retain the remaining portions of the broken bridges 60*a* and 60*b* in the recesses in the exterior surface "Le" of the lid "L". In order to close the lid "L" of the container 10 after a given use, the lid "L" is rotated downwardly so that the edges of the lid "L" come into contact with the edges of the upper portions 16*d*, 18*d*, 20*d*, and 22*d* of the front wall 16, the rear wall 18, the first side wall 20, and the second side wall 22, respectively, of the container 10, whereupon the tab or flap 56 of the latch 54 can grip the keeper 72 to maintain the container 10 in a closed position until the user desires to open the container 10 at a later time. Even more preferably, the latch 54 engages and disengages with a click that can be perceived both by tactile as well as auditory feedback, which give the user additional cues regarding the open or closed state of the lid "L" and the contained 10.

As shown in FIGS. 1 & 16, a tamper-indicating seal 76 can be adhered to the front or another place on the container to present evidence of tampering, damage, or other circumstance. In FIG. 1, the tamper seal 76 is affixed to wall 16 and the lid "L" of the container 10 to provide a visual indication as to whether the container 10 has been opened prior to being sold. In one embodiment, the tamper-indicating seal 76 comprises a backing 76*a* adhered to a layer of adhesive (not shown). The backing 76*a* can be a sheet of tearable paper or tearable polymeric material. The adhesive can be a moderately to highly aggressive adhesive. The tamper seal 76 can be positioned in a number of equally effective locations, including for purposes of example without limitation, across the interface between the lids and walls as well as in appropriate locations across the contemplated assemblies of collars and lids.

It is preferred that a score line or a line of perforations be present in the backing 76*a* of the tamper-indicating seal 76 at the line where the lid "L" meets the upper portion 16*d* of the front wall 16 of the container 10. An attempt the open the container 10 will result in tearing the backing 76*a* along the score line or the line of perforation, thereby indicating visually an unauthorized attempt to open or an actual opening of the container 10.

The dimensions of the container 10 and the components thereof are not critical. However, for the purpose of illustration, typical dimensions of the various components can be as follows:

Top wall 12 and bottom wall 14: 4 in. to 5 in.×5.5 in to 6.5 in.

Front wall 16 and rear wall 18: 5.5 in. to 7.5 in.×5.5 in. to 6.5 in.

First side wall 20 and second side wall 22: 4 in. to 5 in.×5.5 in. to 7.5 in.

Volume of container 10 to contain powder weights of: 10 to 60 oz.; more typically 20 to 40 oz.; for example 23 oz. to 34 oz.

There are numerous methods of making the container 10 described herein. However, in order to facilitate mass production of containers having a variety of volumes, the container 10 can be assembled in a variety of equally suitable ways and by using any of a number of effective and optionally preferred mechanisms. For purposes of illustration without limitation, the exemplary configurations shown here contemplate friction-fit, clip, and similar types of lid-collar-container assembly devices. Such examples can be seen in the various figures including in FIGS. 4-8, and later in other variations and modifications of the embodiments of the invention depicted in FIGS. 16-28.

Referring now to FIGS. 4, 5, 6, 7, and 8, a tub-shaped receptacle 80 comprising the bottom wall 14, the lower portion 16*e* of the front wall 16, the lower portion 18*e* of the rear wall 18, the lower portion 20*e* of the first side wall 20, and the lower portion 22*e* of the second side wall 22 can be provided by a supplier. The lower portion 16*e* of the front wall 16, the lower portion 18*e* of the rear wall 18, the lower portion 20*e* of the first side wall 20, and the lower portion 22*e* of the second side wall 22 typically comprise about from about 60% to about 90% of the height of the aforementioned front wall 16, rear wall 18 first side wall 20, and second side wall 22, respectively.

An assembly 82 comprising a collar 84 and the lid "L" (alternatively referred to herein as "collar/lid assembly 82") can be provided by a supplier. The collar/lid assembly 82 comprises the top wall 12, the upper portion 16*d* of the front wall 16, the upper portion 18*d* of the rear wall 18, the upper portion 20*d* of the first side wall 20, and the upper portion 22*d* of the second side wall 22. The upper portion 16*d* of the front wall 16, the upper portion 18*d* of the rear wall 18, the upper portion 20*d* of the first side wall 20, and the upper portion 22*d* of the second side wall 22 typically comprise from about 10% to about 40% of the height of the front wall 16, rear wall 18 first side wall 20, and second side wall 22, respectively.

The ratios for the lower portion 16*e* of the front wall 16, the lower portion 18*e* of the rear wall 18, the lower portion 20*e* of the first side wall 20, and the lower portion 22*e* of the second side wall 22 and the ratios for the upper portion 16*d* of the front wall 16, the upper portion 18*d* of the rear wall 18, the upper portion 20*d* of the first side wall 20, and the upper portion 22*d* of the second side wall 22 primarily depend upon the volume of the container 10, which in turn depends upon the volume of the tub-shaped receptacle 80. The size of the assembly 82 of the collar and lid essentially remains constant, but the volume of the tub-shaped receptacle 80 varies to provide containers of various volumes.

Various attachment methods for combining the collar and lid assembly with the receptacle are contemplated by the invention, and combinations and variations may be found to be equally suitable and can be interchanged as needed as can be better understood with reference to FIGS. 3-4, 10-13, and 16-36. Referring first to FIGS. 3-4 and 10-13, those skilled in the art will see that in one variation of the preferred embodiments of the invention, each corner 84*a*, 84*b*, 84*c*, and 84*d* of the collar 84 has at least one guide fin 86*a*, and preferably two guide fins 86*a*, 86*b*, to properly align the collar 84 with the tub-shaped receptacle 80. The tub-shaped receptacle 80 is made up of the bottom wall 14 and those portions of the front wall 16, the rear wall 18, the first side wall 20, and the second side wall 22 that are not made up of the upper portions 16*d*, 18*d*, 20*d*, and 22*d* of the front wall 16, the rear wall 18, the first side wall 20, and the second side wall 22, respectively, which upper portions 16*d*, 18*d*, 20*d*, and 22*d* make up the collar 84.

The collar 84 is joined to the tub-shaped receptacle 80 by aligning the guide fins 86*a*, 86*b* in each corner 84*a*, 84*b*, 84*c*, and 84*d* of the collar 84 with the corners 80*a*, 80*b*, 80*c*, and 80*d* located at a sealing flange or rim 88 of the tub-shaped receptacle 80 and press-fitting the collar 84 to the tub-shaped receptacle 80. The sealing flange or rim 88 terminates in an internal edge 89 that defines an opening to the hollow interior space "H".

The guide fins 86*a*, 86*b* in each corner 84*a*, 84*b*, 84*c*, and 84*d* of the collar 84 snugly fit into a groove 90 running around the exterior periphery of the tub-shaped receptacle 80. After the collar 84 is joined to the tub-shaped receptacle 80, the tamper-indicating seal 76 is applied to the front wall 16 and the lid "L" of the container 10. The later described interlocking and lid, collar, receptacle combining features illustrated in FIGS. 16-29 are also contemplated for use in the instant embodiments and modifications thereto. The instant described attachment features are similarly susceptible for use with the later described embodiments discussed below.

The position of the substantially moisture-impervious, oxygen-impervious seal 28 inside of the container 10 is a matter of choice. In one embodiment, the substantially moisture-impervious, oxygen-impervious seal 28 can be applied directly to the sealing flange or rim 88, which is an attach surface running around the periphery of the tub-shaped receptacle 80 by means of an adhesive, typically a heat-sealable adhesive. See FIGS. 14, 20, 23, and 26. In another embodiment, the seal 28 can be applied to the interior walls 16*a*, 18*a*, 20*a*, and 22*a* of the front wall 16, the rear wall 18, the first side wall 20, and the second side wall 22, respectively, of the container 10 at a position lower than the rim 88 running around the periphery of the tub-shaped receptacle 80 of the container 10, such as, for example, at a point approximately midway or lower on the groove 90 that runs around the periphery of the tub-shaped receptacle 80. This embodiment may call for custom attaching equipment, but may be desirable because movement of granular product into cracks and fissures between the tub-shaped receptacle 80 and the collar 84 can be reduced.

Figure 3:
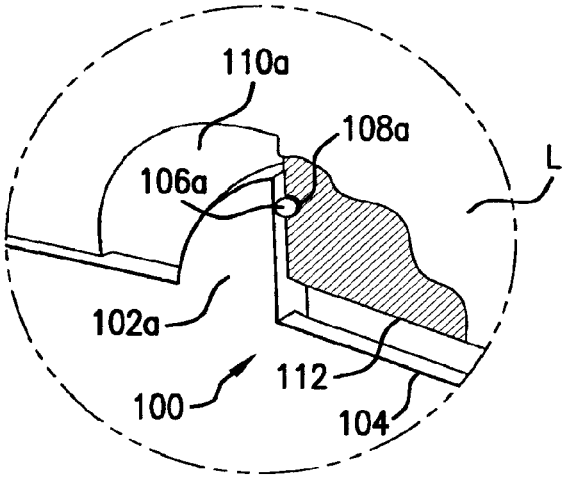
FIG. 3 is a perspective view, greatly enlarged, of the area designated by the line 3-3 in FIG. 2. This figure shows a cut-away view of a mechanical hinge.

The use of a living hinge or a mechanical hinge for pivotally and/or hingedly joining the lid "L" to the collar 84 is also a matter of choice. Referring now to FIGS. 2 and 3, in one embodiment employing a mechanical hinge 100 (see FIG. 3 and also FIGS. 16-19, 24, and 29-31), pins can be molded into projections 102*a*, 102*b*, respectively, rising upwardly from the upper rear edge 104 of the collar 84. These projections 102*a*, 102*b* can be molded so as to be flush with the exterior surface of the collar 84. FIG. 3 shows the projection 102*a* in greater detail. The projection 102*a* has a pin 106*a* formed thereon by molding. The projection 102*b* also has a pin formed thereon by molding.

While the pin on the projection 102*b* is not shown, it is the mirror image of the pin 106*a*. Sockets can be formed in the lid "L" to receive and retain the pins of the projections 102*a*, 102*b*. FIG. 3 shows the socket 108*a* for receiving the pin 106*a*. While the socket for receiving the pin of the projection 102*b* is not shown, it is the mirror image of the socket 108*a*. The lid "L" can be molded in such a manner that the sockets are not visible from the exterior of the container 10. In addition, the lid "L" can be molded in such a manner that recesses 110*a*, 110*b* are provided therein so that the pin-bearing projections 102*a*, 102*b* can be flush with the exterior surface of the lid "L".

In addition, the shape of the rear edge 112 of the lid "L" and the shape of the upper rear edge 104 of the collar 84 can be designed in such a manner that when the lid "L" is fully opened, the lid "L" will be supported by the upper rear edge 104 of the collar 84 at a specified angle, such as, for example, 120°, so that the user can obtain access to the contents of the container 10 without being restricted by the presence of the lid "L". In the particular embodiment shown in FIG. 2, two projections, each projection bearing a pin, and two sockets can be used.

Any and all of the preceding preferred embodiments and the modifications and variations thereof may be incorporated in whole or in part to many additionally contemplated configurations of the container 10. Similarly, the many next to be discussed adaptations, variations, and modifications, are contemplated for use with all of the preceding embodiments, alone, in part, and in combination. With continued reference to FIGS. 1-15, and referring now also to FIGS. 16 through 22, another configuration of a sealing container according to the invention is shown and identified generally by reference numeral 210, which is also susceptible for use and to incorporate any or all of the previously described features, components, and modifications and variations of the invention.

As with other embodiments, the sealing container 210 includes a top wall 212, a bottom wall 214, a front wall 216, a rear wall 218, a first side wall 220, and a second side wall 222, which together define an interior space "I". Similar to other embodiments of the invention, the walls are defined with interior and exterior surfaces and upper and lower portions. The front wall 216 includes an interior surface 216*a*, an exterior surface 216*b*, an upper portion 216*d*, and a lower portion 216*e*. The rear wall 218 has an interior surface 218*a*, an exterior surface 218*b*, an upper portion 218*d*, and a lower portion 218*e*. The first side wall 220 defines an interior surface 220*a*, an exterior surface 220*b*, an upper portion 220*d*, and a lower portion 220*e*. The second side wall 222 includes an interior surface 222*a*, an exterior surface 222*b*, an upper portion 222*d*, and a lower portion 222*e*.

With reference now also to FIGS. 29-31 and 34-36, it may be understood that a lid of the container 210 may be a separate component, part of an assembly, and may also include and be formed as a part of the top wall 212 and the upper portion 216*d* of the front wall 216, the upper portion 218*d* of the rear wall 218, the upper portion 220*d* of the first side wall 220, and the upper portion 222*d* of the second side wall 222.

An alternative configuration of the lid depicted here is referred to generally by reference character "D". The lid "D" has an interior surface, which will hereinafter be referred to by the reference character "Di" (FIGS. 30-31). The lid also has an exterior surface, which will hereinafter be designated by the reference character "De". The lid "D" may also be shaped to cooperate with the features of the bottom wall 214 to enable stacking of the containers 210 as described in earlier descriptions of the embodiments of the invention. As contemplated for use with this and the other previously and later described embodiments of the invention, the lid "D" is shown as a separate component that is hingedly, rotatably, and/or pivotally connect to the containers of the invention. Even more preferably, the lid "D" may be connected to the later described collar for incorporation into the variations of the embodiments of the invention.

An alternative hinge 224 may attach the lid "D" to the upper portion 218*d* of the rear wall 218. While any of the previously described hinges may be incorporated in the embodiment contemplated by sealing container 210, the modified mechanical hinge 224 as shown in the various figures may be incorporated to replace or work in combination with any of the preceding hinges.

The modified variations of the sealing container 210 may also incorporate gripping features such as those previously described and as shown in FIGS. 16-19 and 21, wherein the front wall 216 has a recess 226*a* arranged to enable grasping or gripping of the container 210 by a left thumb of the user. The rear wall 218 also has a recess 226*b* positioned to facilitate gripping of the container 210 by the fingers of the left hand of the user. The recess 226*a* can further have an additional recess 227*a* to indicate the precise location in the recess 26*a* for the placement of the thumb of the user. The recess 227*a* is smaller in area than the recess 226*a*. The recess 227*a* is preferably circular in shape, but other shapes are also acceptable. The recess 226*b* can further have an additional recess 227*b* to indicate the precise location in the recess 226*b* for the placement of the desired finger of the user. The recess 227*b* is smaller in area than the recess 226*b*. The recess 227*b* is preferably circular in shape, but other shapes are also acceptable. In FIGS. 16-19, the recesses 226*a* and 226*b* are positioned adjacent to the first side wall 220 of the container 210. However, variations (not shown) will incorporate the recesses to be complemented by additional and/or replacement recesses proximate the opposite second side 222.

With reference now also to FIGS. 13, 20-21, 23, and 26, the substantially moisture-impervious, oxygen-impervious seal 28 having a pull tab 28*a* is affixed to a position proximate to edges of the upper portions 216*d*, 218*d*, 220*d*, 222*d* of the walls 216, 218, 220, 222 as explained in connection with previously described variations of the preferred embodiments of the invention.

Referring now to FIGS. 30-33, attached to the interior surface "Di" of the lid "D" is the previously described scoop holder 30 and scoop 32. A variation to earlier embodiments of the scoop 32 includes a stiffened handle 34 having a stiffener 34*b* integrally formed thereon. Additionally, the first bracket bowl cover 30*a* of the holder 30 may be projected outward to a predetermined maximum dimension whereby multiple scoops 32 having different volumes of bowl 36 can be incorporated to maximize convenience when dispensing different volumes of the contents of the containers 10, 210.

In another preferred or optional variation to any of the preceding embodiments, and with reference to FIGS. 16-19, 20-22, and 26, the container 210 may be formed from a tub-shaped receptacle 280 similar in construction to earlier described embodiments but may also incorporate upper portions 16*d*, 18*d*, 20*d*, 22*d* of walls 16, 18, 20, 22 having an upper end 282. The upper end 282 defines a sealing flange 284 having an internal edge 286 that defines an opening to the interior space "I".

In further preferred arrangements, the impervious seal 28 is seated around the upper end 282 to close and seal the opening and is removably affixed to the sealing flange 284. To improve accuracy and convenience during assembly and placement of the impervious seal 28 on the sealing flange 284, an optional snap bead 288 (FIGS. 23 & 26) may be formed on the upper end 282 below the sealing flange.

Such a snap bead 288 can be used as a shelf and/or seat that contacts the edges of the unattached impervious seal around the periphery of the container to keep the impervious seal 28 in place and centered so that it can be attached with adhesive, heat sealing, or another means.

In the past, many containers were improperly sealed due to incorrect placement of the seal before an adhesion step glues, melts, or otherwise affixes the impervious seal 28 to the sealing flange 284. Additional variations of any of the embodiments of the invention may also include assembly improving features such as one or more engagement recesses or indentations 290 defined laterally separated by strengthening bridges 292, a lower seat rib 294, and an upper lug ledge or downwardly facing top surface 296.

The spaced apart bridge 292 arrangement imparts improved strength and rigidity capabilities to the upper end 282 of the receptacle 280, which, in turn, improves the crippling strength of the container and the rigidity of the upper end 282 when the collar 300 is fitted together with the receptacle 280. Further preferred or optional variations to any of the preceding embodiments may include a modified collar 300 that can be best illustrated with specific reference to FIGS. 16-21, 24, -28. The collar 300 may be formed with a substantially J-shaped and/or U-shaped cross-sectional configuration. With reference to the various figures, it can be seen that the exemplary collar 300 has an upside-down U-shape and/or J-shape.

The collar 300 includes an exteriorly or outwardly facing long wall 302 that extends upward to join a substantially rounded portion 304 that may have an increased thickness if needed for stiffening the collar 300. The small relative radius of the J-shaped section shown in the illustrations enables excellent stress distribution and force load path communication by way of a higher cross-sectional moment of inertia, which results in a stiffened and stronger collar. The long wall 302 also forms a part of the upper portions 216*d*, 218*d*, 220*d*, 222*d* of the walls 216, 218, 220, 222.

The rounded portion 304 extends further and downwardly to form an interiorly or inwardly facing short wall 306. More preferably, the rounded portion 304 will be formed to have a lip seat 305 that enables alignment and improved engagement of the outermost edge 348 of lid "D" when it is closed onto the collar 300. See, for example, FIGS. 25-26.

The collar may also preferably incorporate engagement lugs or flex clips 310 that are laterally spaced apart to correspond to the lateral spacing of the indentations 290. The flex clips 310 will incorporate an upwardly facing surface and/or a retainer face 312 and may also optionally include a stiffening rib 314. During assembly, the collar 300 will be centered and aligned by the flex clips 310 and thus arranged to fit on, overcap, and/or be installed upon the upper end 282 of the tub-shaped receptacle 280 so that the flex clips 310 will bend outwardly slightly as the collar 300 descends over the upper end 282.

Once the flex clips 310 are moved into a juxtaposition relationship with the indentations 290, the flex clips 310 return to the nominal orientation and snap into position so that the retainer faces 312 contact the downwardly facing top surfaces 296 to interlock the collar 300 onto the receptacle 280. In this way, the collar 300 is captured and in a friction-fit and flex clip 310 engaged relationship with the tub-shaped receptacle 280. A bottom end 303 (FIG. 26) of the outwardly facing long wall 302 will generally come into contact with and rest against the lower seat rib 294 of the receptacle 280, which in combination with the other features of the invention enables increased strength and rigidity.

The laterally spaced apart indentations 290 and bridges 292 establish a well-distributed load interface between the collar 300 and the receptacle 280 having good rigidity properties when subjected to nominal applications. Additionally, the laterally spaced apart bridges 292 have been found to greatly improve the crippling strength of the assembled collar 310 and receptacle 280 combination. These features combine with the capture and retain capability of the flex clips 310 to hold the collar 300 to the upper portion or upper end 282 of the container 210 and thereby laterally stabilize the collar 300 so that the collar 300 remains in a substantially fixed position relative to the container opening.

In additionally preferred and optional modifications to any of the embodiments of the invention, the plurality of indentations 292 and the plurality of spaced apart flex clips 310 are further positioned to be oppositely paired across the receptacle 280 to establish force load coupling between the pairs to increase rigidity and structural stability of the sealable containers 10, 210 when the collar 300 is fitted onto the upper end or portion 282. This opposite or confronted pairing establishes a series of coupled moment arm vectors having a distance equal to the diameter, width, and/or depth dimension of the container, which greatly improves load distribution across the container 10, 210 and increase the structural stability thereof.

Furthermore, it has been found that these novel features have resulted in an unexpected configuration that overcomes otherwise unacceptable tolerance anomalies and part mismatch between the collar 300 and the upper portion or upper end 282 of the receptacle 280, which greatly reduces rejected parts and which significantly lowers manufacturing costs. More specifically, it is optionally preferred to incorporate the upwardly facing surfaces or retainer lugs 312 to be dimensionally smaller than the downwardly facing surfaces or upper lug ledges 296 of the receptacle 280.

In one aspect, this dimensional arrangement can enable the retainer lugs or upwardly facing surfaces 312 to move within the engagement recesses or indentations 290 and about the upper lug ledges or downwardly facing surfaces 296. This can enable the combination of these components to absorb dimensional tolerance errors and enable the collar to fit around the upper portion of the container. Even more preferably, at least one of the collar 300 and the upper end or portion of the walls 282 are formed from a substantially flexible material such as a polymeric material like polyethylene or polypropylene to enable at least one of the collar and the upper portion of the walls to flex.

Flexibility enables absorption of dimensional tolerance errors, which enables the collar to fit around the upper portion of the container. Also, this can enable at least one of the collar 300 and the upper portion or end 282 of the walls to flex to accommodate shape mismatch between at least one of the collar and the upper portion of the walls to enable the collar to fit around the upper portion of the walls.

When assembled, the collar 310 and the upper end 282 of the receptacle 280 form a subcollar space 320 (FIG. 26). In other optionally preferred arrangements of the collar 300, a raised seat 325 may be formed on the inwardly facing short wall 306 to establish a greater thickness of the short wall 306 for applications where other elements may be attached to the short wall. In one particularly preferred optional embodiment, a flexible, polymeric gasket or seal 330 may be affixed to the short wall 306, and more preferably may be attached to the raised seat 325. Even more preferably, the flexible gasket 330 may be either affixed by adhesive to the short wall 306 and/or the raised step 325, or may be directly injection molded onto the short wall 306 and/or the raised step 325.

In this particular example, the raised seat 325 may be also thermoformed as the collar 310 is formed or molded, or the raised seat 325 may be formed in a second and/or separate thermoforming step that may occur before the gasket 330 is attached. Additionally, the raised seat 325 may be formed in the step at the same time or nearly the same time the gasket 335 is attached. The flexible gasket preferably extends inwardly and interiorly with an internal edge 332.

Preferably, the flexible gasket is dimensioned to project inwardly or interiorly and to removably rest against the sealing flange 284 as depicted in FIGS. 23 and 28. More preferably, the flexible gasket 330 projects slightly downwardly to to be biased against the sealing flange 284 for an improved sealing configuration. Even more preferably, the flexible gasket 330 extends interiorly or inwardly to project the internal edge 332 beyond the internal edge 286 of the sealing flange 284. With this arrangement, the subcollar space 320 is sealed from the interior space "I" to prevent contents of the interior space "I" from entering the subcollar space 320. If such is not prevented, an inconvenience is presented wherein contents that have spilled into the subcollar space 320 may further spill outside the container 210 by moving through any interstice that may exist between the lower end of the outwardly facing long wall 302 and the lower seat rib 294 (FIG. 26).

With specific reference to FIGS. 20, 23, and 26, those skilled in the art may comprehend that the impervious seal 28 is removably sandwiched between the gasket 330 and the sealing flange 284 (and beneath the gasket 330). When pull tab 28*a* is grasped and the impervious seal 28 is removed to expose the contents of the container 210, the flexible gasket 330 flexes away from its rest position against the sealing flange 284 to enable removal of the impervious seal 28. As the impervious seal 28 is removed, the flexible gasket 330 returns to its rest position against the sealing flange 284. This configuration permits a more robust hermetic, impervious seal 28 for distribution to the end user, who removes the seal 28 upon first use, yet still enjoys the benefits of the sealing wall and gasket 330 to prevent or minimize content leakage.

Many possible types of material are suitable for use in fabricating the gasket 330. One illustrative example of a suitable material includes a thin polymeric material such as a thermo-plastic elastomer having a durometer strength of approximately 50 or other similar Shore A grade material so that the impervious seal 28 may be easily removed while the flexible gasket is still able to retain some shape memory so that it returns to a biased, sealing rest position against the sealing flange 284. For optionally preferred applications, Shore A grade material such as a Santoprene and similar compounds have been found to be satisfactory and can be readily thermoformed or injection molded directly onto the inwardly facing short wall 306 and/or the raised seat 325.

In other equally preferred and optional variations to any of the embodiments of the invention, the gasket 330 may be integrally formed as part of the collar 300 wherein the gasket 330 is a flap of flexible and thin material that is molded from and that extends from the interior surface of the collar 300. In this contemplated modification to any of the embodiments, among other options, the raised seat 325 can be formed to project inwardly as the gasket 330.

Other modifications to the preferred embodiments of the containers 10, 210 may incorporate a modified removable lid such as lid "D" shown in FIGS. 30 through 36. The new variation contemplated by removable lid "D" preferably defines the interior surface "Di" to be sized to cover and seal the opening to the interior space "I" when the lid "D" is closed. The lid "D" incorporates a sealing wall 340 depending from its interior surface "Di" and that projects toward the sealing flange 284 and which is centered and aligned by including optionally preferred alignment and/or wall ribs 341 (FIGS. 30-31).

With this configuration, when the lid "D" is closed on the collar 300 to seal the container 210, the gasket 330, the sealing wall 340, and the sealing flange 284 are dimensioned and positioned so that the sealing wall 340 depresses and biases the flexible gasket 330 against the internal edge 286 of the sealing flange 284 to seal the subcollar space 320 from the container interior "I". The flexibility and shape memory and strength of the flexible gasket 330 must also withstand repeated opening and closing of the lid "D" and biasing and unbiasing of the gasket 330 by the moving sealing wall 340, so that the flexible gasket remains biased and at rest against the sealing flange 384. These optionally preferred variations of the position of the sealing wall 340 are contemplated as shown with the solid and dashed line representations of sealing wall 340 shown in FIG. 26.

In any of the possibly preferred positions of sealing wall 340, the length and/or location of the downwardly projecting lower edge 342 is adjustable as preferred so that the lower edge 342 can, when lid "L" or "D" is in the closed position, terminate just above, bias against, and/or bias against and depress gasket 300 downward so that gasket 330 is in turn biased against sealing flange 284. In further alternative variations to the preceding embodiments, the flexible gasket 330 may be attached to the sealing wall 340 instead of the raised seat 325. In further variations, a second gasket (not shown) may be attached to the sealing wall 340 either alone and/or in addition to and to cooperate with the flexible gasket 330 that is attached to the raised seat 325.

In still other modifications to any of the variations of the preferred embodiments, the sealing wall 340 may be implemented to function with or without the use of a gasket 330 and may include a funneled lower edge 342 such as those shown in FIGS. 27 and 28. In FIG. 27, the funneled lower edge 342 includes an inwardly curved and/or inwardly tapering sealing wall 340*a*. In FIG. 28, the funneled lower edge 342 incorporates an inwardly slanted and/or tapering sealing wall 340*b*. A combination of a slanted and/or curved and tapering wall 340*a* and 340*b* is also contemplated, which can be used either alone and/or in combination with the flexible and/or integral gasket 330 illustrated elsewhere herein. Particularly in embodiments not using the gasket 330, the sealing wall 340 may be dimensioned so that when the lid "D" is closed, the sealing wall 340 remains inward of the sealing flange 284.

In further preferred variations to the preceding embodiments, the lid "D" more preferably includes a substantially domed central section 344 that has dimensions less than the sealing wall 340. The domed central section is joined to the lid either by the sealing wall, by an angled wall 346, and by a combination thereof, wherein the angled wall 346 tapers from the domed central section down to the interior surface "$D_i$" proximate to the sealing wall 340 (FIGS. 34-36). As with earlier discussed embodiments and modifications thereto, the modified lid "D" is configured with an overall shape that cooperates with the shape of the bottom wall 14 to enable easy stacking of the containers 210. Proximate to the junction of the sealing wall 340 and the angled tapered wall 346, a collar engagement member projects generally downward to a lip edge 348 that seats into and engages with lip seat 305 of the collar 300, so that when the lid "D" is closed, a more rigid and tightly closed assembly of collar 300 and lid "D" is established.

In the adaptation wherein the substantially domed central section 344 is connected only by the sealing wall 340, essentially the tapered angled wall 346 merges with the sealing wall 340 to have an angle relative to the vertical direction of approximately 90 degrees. The tapered angled wall 346 is in other variations arranged to have an angle relative to a vertical direction of between approximately 10 and approximately 75 degrees, and preferably between about 15 and 60 degrees, and more preferably between about 25 and 45 degrees, and even more preferably approximately 30 degrees. The substantially domed central section 344 extending to the sealing wall preferably is dimensioned to define an area between approximately 20 percent and approximately 80 percent smaller than an entire area defined by the removable lid. Further, the substantially domed central section 344 projects upwardly with a height dimension that is between approximately 10 percent and approximately 60 percent of a cumulative lid height dimension; ideally to house the scoop above the impervious seal 28.

These variations of the substantially domed lid have been found to be of significance when the sealable container 210 is in use with powdered contents contained therein. When the container 210 is jostled about and inverted during transit, such as when being transported in the diaper bag of a parent or when being shipped from a warehouse to a retail location while being upside-down and inverted, the powdered contents may collect and become packed into a small mountain resting against portions of the interior surface "$D_i$" of the lid "D". When such a disoriented container is righted, the angled wall 346 and the sealing wall 340 cooperate to more readily and effectively disengage the collected and/or packed contents from the interior surface "$D_i$" of the lid "D" so that the packed or collected contents fall freely down into the interior space "I" of the container 210.

Many factors can contribute to creating an inconvenient accumulation of powder packed into the lid "L" or "D". Those skilled in the relevant arts often characterize the flowability of a powdered material to be a function of many variables that include particle size and distribution, cohesivity, static charge, surface coating, ability to recover from packing or compaction, temperature, humidity, aeration, transportation experience, and container surface effects. Even with so many powder flowability characteristics confronted the manufacturer and the user of container according to the principles of the invention, it has been found that the new and novel angled and/or tapered wall 346 of the invention, alone and in combination with the other powder control features described herein, have established a new and previously unseen means of directing powdered contents back into the interior space "H" upon righting of the containers 10, 210.

The arrangement of the flexible gasket 330 biased at rest against the sealing flange 284 further cooperates to mostly if not entirely prevent the contents from entering the subcollar space 320 while directing the contents back into the interior space "I". Additionally, the arrangement of the flexible gasket 330 and its internal edge 332 extending inwardly beyond the internal edge 286 of the sealing flange 284 also serves to better direct the contents away from the subcollar space 320 and into the interior space "I". Also, the powder directing capabilities can be further implemented with any combination of the flexible and integral gaskets 330, whether used alone and/or in combination with the straight, funneled, curved, and slanted sealing wall 340 variations described above.

In any of the embodiments of the invention where a powder control feature is implemented as described here, significant advantages are achieved by ensuring that powdered and granular contents are dropped into the interior space "H" and away from the interior surfaces "$L_i$" and "$D_i$" of lids "L" and "D", and are prevented from entering the subcollar space 320

As previously described in connection with earlier embodiment and variations thereof, a living hinge or a mechanical hinge can be used to hingedly and/or pivotally attach the lid "D" to the collar 300. Referring to FIGS. 23 and 30, among others, it can be seen that the mechanical hinge adaptation can include the hinge 224 having a hinge separation or wheel base that is farther apart than earlier described embodiments, which can improve the strength thereof. Another possibly preferred mechanical hinge can include a pinned hinge having cooperative detentes and engagement ridges that enable a frictional ratcheting of the lid "D" between the open and closed positions, which prevents the lid "D" from falling closed while contents are being removed from the interior space 320.

In another contemplated variation of the preferred embodiments of the invention, the receptacle 280 of the container 210 is further modified to incorporate a means to compensate for changing external pressures due to altitude changes of the sealed container 210. Ordinarily, the container 210 is sealed with impervious seal 28 whereby the pressure in the interior space "I" remains unchanged. However, distribution of container 210 after filling with salable contents creates the probability that the filled containers 210 will experience widely varying pressure changes. Such changes may lead to breach or rupture of the impervious seal 28. A stronger, pressure resistant seal 28 may be undesirable because the user may not have enough strength to open the impervious seal 28.

Accordingly, as can be seen with reference to FIGS. 17-18, and 37, the bottom surface 214*a* of the bottom wall 214 of the receptacle 280 may incorporate a pressure control portion formed from a stepped or central raised stepped or stiffener portion 350 formed with an outer planar portion 352 adapted to enable the container 210 to rest in a level position on a flat surface such as a table or counter-top.

The pressure control portion is also referred to as the central raised stiffener portion 350. Contrary to the plain meaning of the word "stiffener", this phrase refers to features that may be incorporated and which include, for purposes of example without limitation, a flexible and/or collapsible pressure relief section.

Extending towards the interior space "I", the central raised stepped or stiffener portion 350 includes a plurality of steps 354 having riser portions 356 and tread portions 358. The riser portions 356 preferably project in a direction substantially upward relative to the outer planar portion 352 with the tread portions 358 being approximately parallel to the outer planar portion 352.

More preferably, the steps 354 that are formed from the riser and tread portions 356, 358 can form 3, 4, 5 or more or less steps that together can enable an incremental reduction in pressure by the incremental collapse of one or all of the steps so that pressure in the interior space "I" may be lowered to compensate for unequal pressure and to lessen any pressure between the interior space "I" and the external atmosphere. In this way, when a container such as containers 10, 210 are filled with contents at a sea level factory, and the containers are shipped via aircraft or over high-altitude land routes, the impervious seal 28 of the containers 10, 210 may remain intact despite varying external pressures. Alternatively, the steps 354 may be adapted to have a thickness and or a bellows and or an accordion cross-sectional structure similar to that shown in FIGS. 17-18 and FIGS. 37, 38*a-b*, and 39*a-b*, and that establishes a material strength that prevents collapse and that resists deformation of the bottom wall 214 when exposed to such pressure differentials. Even more preferably, the steps 354 include a combination of steps that resist collapse and or deformation when exposed to a pressure differential as well as steps that are formed with a reduced cross-sectional thickness (FIGS. 38*a-b*) or with a type of flexible bellows or accordion or pleated section (FIGS. 39*a-b*) that exaggerates the undulations of or that is combined with the steps as shown in FIGS. 17-18, and 37, 38*a-b* and 39*a-b*. Although shown in FIGS. 39*a-b* to have a generally undulating bellows type of profile, and more triangular or pleated undulation arrangement may also be optionally incorporated.

Most preferably, the undulating bellows arrangement (FIGS. 39*a-b*) may retain the stackable capability by preserving the cooperative shapes between the lids "D" or "L" and the recess defined by the bottom wall 14. This flexible and/or bellows adaptation of the steps 354 preferably retains the stackability clearance and spacing of earlier configurations by generally following the curvature of inclination line 360 (FIGS. 39*a-b*), which extends inwardly towards the interior space "I" or "H" so that any flexure or collapse of a portion of the steps 354 relieves some or all of the pressure differential without detriment to stackability. These stepped arrangements may be used alone or in combination with one or more of the arrangements of FIGS. 17-18 as well as the more flexible reduced thickness variation of FIGS. 38*a-b*. With any of these alternative configurations, the steps 354 may be optionally or preferably adapted to collapse and or flex in response to the contemplated pressure differential in a way that accommodates and/or reduces any stress on the containers 10, 210 due to pressure changes.

With the multiple stepped arrangement illustrated here, the collapse of one or more steps 354 will preferably not result in the central stepped portion 350 distending beyond the generally level outer planar portion 352. Such pressure differentials may be experienced even without altitude changes. For example, and as discussed elsewhere herein, the containers of the invention may be subjected to external crushing pressures during shipment with a commercial carrier as well as during movement by a parent carrying the inventive in a diaper bag.

The materials of the components of the containers 10 and 210 are not critical. However, certain materials for the components of the container are preferred on account of, for example, such considerations as manufacturing considerations, economic considerations, and consumer considerations. The tub-shaped receptacle typically comprises a multiple-layer material, wherein the multiple-layer material comprises an inner layer, an outer layer and a regrind layer between the inner layer and the outer layer.

Such a multiple-layer material is described in U.S. Patent Application Publication No. 2004/0161558, published Aug. 19, 2004. The assembly comprising the collar 84 and the lid "L" typically comprises a polymeric material, such as, for example, polypropylene, high-density polyethylene. The scoop typically comprises a polymeric material, such as, for example, polypropylene, high-density polyethylene.

Operation

In use, the container 10 or 210 is grasped with a single hand using the enhanced gripping recesses 26*a*, 26*b*, 27*a*, 27*b*, 226*a*, 226*b*, 227*a*, 227*b*. The containers 10, 210 are then opened by actuation of the latch 54 and, if necessary for a new container, the impervious seal 28 is removed by grasping the pull tab 28*a* and pulling the seal 28 away from the sealing flange 284. Next, the user uses his or her free hand to retrieve the scoop 32 from the lid "L" or "D" of the containers 10, 210 to scoop and dispense the contents. The user avoids the inconvenience of powder spilling from the scoop 32 because the bowl 36 was covered by bracket 30*a*. Furthermore, any powdered contents that may have come to rest in the lid "L" or "D" prior to opening, was directed away from the subcollar space 320 and into the interior space "H" where it remains ready for dispensing. The container 10 and the scoop 32 together cooperate as a system that enables the user to conveniently use the scoop 32 to remove a predetermined volume or portion of the contents of the container.

After the scoop 32 has been used, the scoop 32 can be reattached to the scoop holder 30 on the lid "L" for all subsequent times the scoop is to be used. The lid is then closed, securing the powder therein. Accordingly, the granular or powdered product will not be spilled, wasted, or contaminated by contact with the hand of the user.

INDUSTRIAL APPLICABILITY

The embodiments of the present invention are suitable for use in many applications that involve manufacture, distribution, storage, sale, and use of flowable substances such as powders and granular materials. The configurations of the inventive container can be modified to accommodate nearly any conceivable type of such materials, and the shape, size, and arrangement of the features and components of the novel container can be modified according to the principles of the invention as may be required to suit a particular type or quantity of flowable material, as well as a preferred mode of use, storage, manufacture, distribution, and/or sales environment.

Such modifications and alternative arrangements may be further preferred and/or optionally desired to establish compatibility with the wide variety of possible applications that are susceptible for use with the inventive and improved containers for containing flowable materials are described and contemplated herein. Accordingly, even though only few such embodiments, alternatives, variations, and modifications of the present invention are described and illustrated, it is to be understood that the practice of such additional modifications and variations and the equivalents thereof, are within the spirit and scope of the invention as defined in the claims.

Other Variations

Further variations of the invention are described below.

[A]. A sealable container, comprising: walls defining interior and exterior surfaces and an interior space, the walls having an upper portion near an upper end of the walls that defines a sealing flange, the sealing flange having an internal edge that defines an opening to the interior space; a collar having an interior surface adapted to fit around the container near the upper portion and defining a subcollar space between the exterior surface of the container and the interior surface of the collar; a collar-mounted removable lid having an interior surface which, when in a closed position, is adapted to cover and seal the opening, the lid having a sealing wall depending from its interior surface and projecting toward the sealing flange and being dimensioned to remain inward of the sealing flange when in the closed position, the lid further having a substantially domed central section of dimensions less than the sealing wall and joined to the lid by an angled wall tapering from the domed central section down to the interior surface proximate to the sealing wall; and wherein, upon righting a disoriented container having contents, the angled wall and the sealing wall cooperate to direct the contents packed against the interior surface of the lid down into the interior space of the container to substantially prevent entry into the subcollar space.

[B] The sealable container according to [A] further comprising: a flexible gasket carried from the collar and dimensioned to be biased against the sealing flange; and wherein when the lid is in the closed position, the gasket, the sealing wall and the sealing flange are dimensioned such that the sealing wall biases the flexible gasket against the internal edge of the sealing flange to seal the subcollar space from the container interior and whereby the flexible gasket further cooperates with the angled wall and the sealing wall to direct the packed contents into the interior space of the container to substantially prevent entry into the subcollar space.

[C] The sealable container according to [B], wherein the gasket attaches to and depends from the interior surface of the collar, and has an internal edge extending inwardly beyond the internal edge of the sealing flange and wherein when the lid is in an open position, the gasket is arranged to remain biased against the sealing flange to further cooperate in directing the packed contents into the interior space of the container to substantially prevent entry into the subcollar space.

The sealable container according to [C], wherein the tapered angled wall is arranged to have an angle relative to a vertical direction of between approximately 10 degrees and approximately 90 degrees.

The sealable container according to [C], wherein the tapered angled wall is arranged to have an angle relative to a vertical direction of between approximately 15 and approximately 75 degrees.

The sealable container according to [C], wherein the tapered angled wall is arranged to have an angle relative to a vertical direction of between approximately 20 and approximately 60 degrees.

The sealable container according to [C], wherein the tapered angled wall is arranged to have an angle relative to a vertical direction of between approximately 25 and approximately 45 degrees.

The sealable container according to [C], wherein the tapered angled wall is arranged to have an angle relative to a vertical direction of approximately 30 degrees.

[D] The sealable container according to [A], wherein the substantially domed central section extending to the sealing wall defines an area between approximately 20 percent and approximately 80 percent smaller than an area defined by the removable lid.

The sealable container according to [A], wherein the substantially domed central section projects upwardly with a height dimension that is between approximately 10 percent and approximately 60 percent of a cumulative lid height dimension.

The sealable container according to [A], further comprising: a scoop holder projecting from the interior surface of the lid and positioned proximately within the substantially domed central section, the scoop holder having brackets with a cover and a restraint; a scoop having a handle extending from a bowl and adapted to be removably retained in the scoop holder; and wherein when the scoop is retained in the scoop holder, the restraint captures the handle to prevent movement and the cover seals the bowl to prevent the contents from entering the bowl.

The sealable container according to [D], wherein the scoop holder incorporates a first projection extending from the interior surface and having a handle holding notch to hold the handle away from the interior surface in a grasping position.

[E] A sealable container, comprising: walls defining interior and exterior surfaces and an interior space, the walls having an upper portion near an upper end of the walls that defines a sealing flange, the sealing flange having an internal edge that defines an opening to the interior space; a collar having an interior surface adapted to fit around the container near the upper portion and defining a subcollar space between the exterior surface of the container and the interior surface of the collar, the collar having an integral gasket projecting inwardly and in a direction to be biased against the sealing flange; a removable lid movable about the collar and having an interior surface which, when in a closed position, is adapted to cover and seal the opening, the lid having a sealing wall depending from its interior surface and projecting toward the sealing flange and being dimensioned to remain inward of the sealing flange when in the closed position, the lid further having a substantially domed central section of dimensions less than the sealing wall and joined to the lid by an angled wall tapering from the domed central section down to the interior surface proximate to the sealing wall, the angled wall having an angle relative to a vertical direction of between approximately 15 degrees and approximately 75 degrees; and wherein, upon righting a disoriented container having contents, the angled wall and the sealing wall cooperate to direct the contents packed against the interior surface of the lid down into the interior space of the container to substantially prevent entry into the subcollar space.

The sealable container according to [E], wherein the integral gasket extends inwardly beyond the internal edge of the sealing flange.

The sealable container according to [E], further comprising a removable seal extending across the opening and attaching to the sealing flange beneath the integral gasket; and wherein the integral gasket flexes to enable removal of the removable seal and thereafter returns to the biased position against the sealing flange.

The sealable container according to [E], wherein the lid is hingedly connected to the collar to move between open and closed positions.

[F] The sealable container according to [E], wherein the sealing wall funnels inwardly toward a lower edge.

The sealable container according to [F], wherein the sealing wall funnels inwardly toward the lower edge with a geometry selected from the group that includes (a) curving inwardly toward the lower edge, (b) inclining inwardly towards the lower edge, and (c) curving and inclining inwardly towards the lower edge.

[G] A sealable container, comprising: walls defining interior and exterior surfaces and an interior space, the walls having an upper portion near an upper end of the walls that defines a sealing flange, the sealing flange having an internal edge that defines an opening to the interior space; a collar having an interior surface adapted to fit around the container near the upper portion and defining a subcollar space between the exterior surface of the container and the interior surface of the collar; a flexible gasket projecting generally inwardly from the interior surface of the collar to be biased against the sealing flange; a removable lid movable about the collar and having an interior surface which, when in a closed position, is adapted to cover and seal the opening, the lid having a sealing wall depending from its interior surface and projecting toward the sealing flange and being dimensioned to remain inward of the sealing flange when in the closed position, the lid further having a substantially domed central section of dimensions less than the sealing wall and joined to the lid by an angled wall tapering from the domed central section down to the interior surface proximate to the sealing wall, the substantially domed section incorporating a scoop holder having cover and restraint brackets adapted to releasably retain a scoop having a handle extending from a bowl, wherein the cover bracket seals the bowl and the restraint immobilizes the handle in a grasping position; and wherein, upon righting a disoriented container having contents, the angled wall and the sealing wall cooperate to direct the contents packed against the interior surface of the lid down into the interior space of the container to substantially prevent entry into the subcollar space.

The sealable container according to [G], wherein the walls meet to form junctions having a curvilinear profile and wherein the bowl of the scoop is formed with a rim having an edge that is congruent with the curvilinear profile.

The sealable container according to [G], wherein the walls meet to form junctions having an angled profile and wherein the bowl of the scoop is formed with a rim having an edge that substantially matches the angled profile.

The sealable container according to [G], wherein the tapered angled wall is arranged to have an angle relative to a vertical direction of between approximately 25 and approximately 45 degrees.

[H]A sealable container, comprising: walls defining interior and exterior surfaces and an interior space, the walls having an upper portion near an upper end of the walls that defines a sealing flange, the sealing flange having an internal edge that defines an opening to the interior space; a collar having an interior surface adapted to fit around the container near the upper portion and defining a subcollar space between the exterior surface of the container and the interior surface of the collar; a collar-mounted removable lid having an interior surface which, when in a closed position, is adapted to cover and seal the opening, the lid having a sealing wall depending from its interior surface and projecting toward the sealing flange and being dimensioned to remain inward of the sealing flange when in the closed position, the lid further having a substantially domed central section of dimensions less than the sealing wall and joined to the lid by the sealing wall connecting the domed central section to the interior surface; and wherein, upon righting a disoriented container having contents, the sealing wall cooperates with the sealing flange to direct the contents packed against the interior surface of the lid down into the interior space of the container to substantially prevent entry into the subcollar space.

The sealable container according to [H], further comprising: a flexible gasket carried from the collar and dimensioned to be biased against the sealing flange; and wherein when the lid is in the closed position, the gasket, the sealing wall and the sealing flange are dimensioned such that the sealing wall biases the flexible gasket against the internal edge of the sealing flange to seal the subcollar space from the container interior and whereby the flexible gasket further cooperates with the sealing wall to direct the packed contents into the interior space of the container to substantially prevent entry into the subcollar space.

The sealable container according to [H], wherein the gasket attaches to and depends from the interior surface of the collar, and has an internal edge extending inwardly beyond the internal edge of the sealing flange and wherein when the lid is in an open position, the gasket is arranged to remain biased against the sealing flange to further cooperate in directing the packed contents into the interior space of the container to substantially prevent entry into the subcollar space.

Another aspect of the invention follows.

[AA] A sealable container and scoop system, comprising: walls defining interior and exterior surfaces and an interior space, the walls having an upper portion near an upper end of the walls that define an opening to the interior space, the walls joining each other and a bottom surface to define junctions having a particular cross-sectional geometry; a removable lid hingedly attached to the collar and having an interior surface which, when in a closed position, is adapted to cover and seal the opening; and a scoop for removing contents from the interior space of the container, the scoop including a bowl with a rim substantially congruent to the particular cross-sectional geometry of the junctions between the walls and between the walls and the bottom surface of the container.

The sealable container and scoop system according to [AA], wherein the particular cross-sectional geometry of the junctions between the walls and between the walls and the bottom surface approximately form a right angle, and wherein the rim of the bowl includes a portion that is substantially congruent.

The sealable container and scoop system according to [AA], wherein the particular cross-sectional geometry of the junctions between the walls and between the walls and the bottom surface have a curvilinear profile, and wherein the rim of the bowl includes a portion that is substantially congruent.

The sealable container and scoop system according to [AA], wherein the particular cross-sectional geometry of the junctions between the walls and between the walls and the bottom surface approximately form a right angle, and wherein the rim of the bowl includes a portion that is substantially congruent.

A sealable container and scoop system, comprising: walls defining interior and exterior surfaces and a generally cuboid interior space, the walls having an upper portion near an upper end of the walls that define an opening to the interior space, the walls joining each other and a bottom surface to define junctions having a particular cross-sectional geometry; a removable lid having an interior surface which, when in a closed position, is adapted to cover and seal the opening; and a scoop for removing contents from the interior space of the container, the scoop including a bowl with a substantially flexible rim that when biased against the interior surface proximate to the junctions flexes to be congruent to the particular cross-sectional geometry of the junctions.

The sealable container and scoop system according to [AA], wherein the particular cross-sectional geometry of the junctions between the walls and between the walls and the bottom surface approximately form a circular section having a radius, and wherein the rim of the bowl includes a portion having a circular section that is approximately equal to the radius.

The sealable container and scoop system according to [AA], wherein the particular cross-sectional geometry of the junctions between the walls and between the walls and the bottom surface approximately form a circular section having a radius, and wherein the rim of the bowl includes a substantially flexible portion having a circular section that when biased against the junctions flexes to have a profile approximately equal to the radius.

[BB] The sealable container according to [AA], further comprising: the upper portion near the upper end of the walls defining a sealing flange, the sealing flange having an internal edge that defines the opening to the interior space; a collar having an interior surface adapted to fit around the container near the upper portion and defining a subcollar space between the exterior surface of the container and the interior surface of the collar; a flexible gasket carried from the interior surface of the collar and dimensioned to rest against the sealing flange; and wherein when the lid is in the closed position, the gasket, the sealing wall and the sealing flange are dimensioned whereby the sealing wall biases the flexible gasket against the internal edge of the sealing flange to seal the subcollar space from the container interior.

[CC] The sealable container according to [BB], wherein the gasket projects inwardly and extends beyond the internal edge of the sealing flange.

The sealable container according to [CC], wherein the gasket attaches to and depends from a raised surface of the collar, and wherein when the lid is in an open position, the gasket is arranged to remain biased against the sealing flange.

The sealable container according to [BB], further comprising a removable seal extending across the opening and attaching to the sealing flange beneath the flexible gasket; and wherein the flexible gasket flexes to enable removal of the removable seal and thereafter flexes back to rest against the sealing flange.

The sealable container according to [BB], wherein the lid is pivotally connected to the collar to move between open and closed positions.

The sealable container according to [BB], wherein the walls define a substantially cuboid shaped container.

[DD] The sealable container according to [AA], further comprising: the upper portion near the upper end of the walls defining a sealing flange, the sealing flange having an internal edge that defines the opening to the interior space; a collar having an interior surface adapted to fit around the container near the upper portion and incorporating an integral gasket projecting inwardly from the interior surface to rest on the sealing flange, the collar defining a subcollar space between the exterior surface of the container and the interior surface of the collar; and wherein when the lid is in the closed position, the integral gasket, the sealing wall and the sealing flange are dimensioned whereby the sealing wall biases the integral gasket against the internal edge of the sealing flange to seal the subcollar space from the container interior.

The sealable container according to [DD], wherein the gasket projects inwardly and extends beyond the internal edge of the sealing flange.

The sealable container according to [DD], wherein the gasket attaches to and depends from a raised surface of the collar, and wherein when the lid is in an open position, the gasket is arranged to remain biased against the sealing flange.

The sealable container according to [DD], further comprising: a removable seal extending across the opening and attaching to the sealing flange beneath the integral gasket; and wherein the integral gasket flexes to enable removal of the removable seal and thereafter flexes back to rest against the sealing flange.

The sealable container according to [AA], further comprising: the upper portion near the upper end of the walls defining a sealing flange, the sealing flange having an internal edge that defines the opening to the interior space; a collar having an interior surface adapted to fit around the container near the upper portion and defining a subcollar space between the exterior surface of the container and the interior surface of the collar; a removable lid having an interior surface which, when in a closed position, is adapted to cover and seal the opening, the lid having a sealing wall depending from its interior surface and projecting toward the sealing flange and being dimensioned to remain inward of the sealing flange when in the closed position, the lid further having a substantially domed central section of dimensions less than the sealing wall and joined to the lid by an angled wall tapering from the domed central section down to the interior surface proximate to the sealing wall; and wherein, upon righting a disoriented container having contents, the angled wall and the sealing wall cooperate to direct the contents packed against the interior surface of the lid down into the interior space of the container to substantially prevent entry into the subcollar space.

The sealable container according to [EE], further comprising: a flexible gasket carried from the collar and dimensioned to be biased against the sealing flange; and wherein when the lid is in the closed position, the gasket, the sealing wall and the sealing flange are dimensioned such that the sealing wall biases the flexible gasket against the internal edge of the sealing flange to seal the subcollar space from the container interior and whereby the flexible gasket further cooperates with the angled wall and the sealing wall to direct the packed contents into the interior space of the container to substantially prevent entry into the subcollar space.

The sealable container according to [EE], wherein the gasket attaches to and depends from the interior surface of the collar, and has an internal edge extending inwardly beyond the internal edge of the sealing flange and wherein when the lid is in an open position, the gasket is arranged to remain biased against the sealing flange to further cooperate in directing the packed contents into the interior space of the container to substantially prevent entry into the subcollar space.

The sealable container according to [EE], wherein the tapered angled wall is arranged to have an angle relative to a vertical direction of between approximately 25 degrees and approximately 45 degrees.

[FF] The sealable container according to [EE], further comprising: a scoop holder projecting from the interior surface of the lid and positioned proximately within the substantially domed central section, the scoop holder having brackets with a cover and a restraint; a scoop having a handle extending from a bowl and adapted to be removably retained in the scoop holder; and wherein when the scoop is retained in the scoop holder, the restraint captures the handle to prevent movement and the cover seals the bowl to prevent the contents from entering the bowl.

The sealable container according to [FF], wherein the scoop holder incorporates a first projection extending from the interior surface and having a handle holding notch to hold the handle away from the interior surface in a grasping position.

The sealable container according to [EE], wherein the walls define a substantially cuboid shaped container.

Another aspect of the invention follows.

[AAA] A sealable container, comprising: walls defining interior and exterior surfaces and an interior space, the walls having an upper portion near an upper end of the walls that defines an opening to the interior space, the upper portion defining on the exterior surfaces a plurality of indentations projecting interiorly and spaced apart by bridges, the indentations having a downwardly facing top surface; a collar having an interior surface adapted to fit around the container about the upper portion to define a subcollar space between the exterior surface of the container and the interior surface of the collar; and wherein the collar further includes a plurality of spaced apart flex clips formed with upwardly facing surfaces and depending downwardly into the subcollar space and juxtaposed to align with the plurality of indentations enabling the upwardly facing surfaces to engage the downwardly facing top surfaces whereby the flex clips hold the collar to the upper end of the container.

The sealable container according to [AAA], wherein the upwardly facing surfaces are dimensioned to be smaller than the downwardly facing surfaces of the indentations to absorb dimensional tolerance errors and enable the collar to fit around the upper portion of the container.

The sealable container according to [AAA], wherein at least one of the collar and the upper portion of the walls are formed from a substantially flexible material to enable at least one of the collar and the upper portion of the walls to flex to absorb dimensional tolerance errors and enable the collar to fit around the upper portion of the container.

The sealable container according to [AAA], wherein at least one of the collar and the upper portion of the walls are formed from a substantially flexible material to enable at least one of the collar and the upper portion of the walls to flex to accommodate shape mismatch between at least one of the collar and the upper portion of the walls to enable the collar to fit around the upper portion of the walls.

The sealable container according to [AAA], wherein at least one of the collar and the upper portion of the walls are formed from a substantially flexible material to enable at least one of the collar and the upper portion of the walls to flex and wherein the upwardly facing surfaces are dimensioned to be smaller than the downwardly facing surfaces of the indentations to absorb dimensional tolerance errors and to accommodate shape mismatch between at least one of the collar and the upper portion of the walls to enable the collar to fit around the upper portion of the container.

[BBB] The sealable container according to [AAA], wherein the collar has a substantially J-shaped cross-section having an outward projecting long wall, a substantially rounded, stiffening top portion, and an inward short wall that cooperate to define the subcollar space.

[CCC] The sealable container according to [BBB], wherein the short wall cooperates with an internal edge of the upper portion that defines the opening to seal the interior space from the subcollar space.

The sealable container according to [CCC], further comprising: a sealing flange formed in the upper portion and extending to the internal edge; and a flexible gasket projecting from the short wall and sized to rest against the sealing flange and cooperative therewith to seal the interior space from the subcollar space.

The sealable container according to [AAA], wherein the walls further define the container to have a substantially cuboid shape, and wherein the plurality of indentations and the plurality of spaced apart flex clips are further positioned to be paired across opposite facing walls to establish force coupling between the pairs to increase rigidity and structural stability of the sealable container when the collar is fitted onto the upper portion.

The sealable container according to [AAA], wherein the plurality of indentations and the plurality of spaced apart flex clips are further positioned to be paired with opposite facing indentations and clips of the plurality to establish an aligning capability between the collar and the upper portion of the walls.

The sealable container according to [AAA], wherein each of the plurality of flex clips incorporate at least one stiffening rib.

[DDD] The sealable container according to [AAA], wherein the upper portion near the upper end of the walls defines a sealing flange having an internal edge that defines the opening to the interior space; a removable lid having an interior surface which, when in a closed position, is adapted to cover and seal the opening, the lid having a sealing wall depending from its surface and projecting toward the sealing flange and being dimensioned to remain inward of the sealing flange when in the closed position; a flexible gasket dimensioned to removably rest against the sealing flange and carried from a surface of a group that includes (a) the interior surface of the collar, (b) the interior surface of the walls, and (c) the sealing wall of the lid; and wherein when the lid is in the closed position, the gasket, the sealing wall and the sealing flange are dimensioned such that the sealing wall biases the flexible gasket against the internal edge of the sealing flange to seal the subcollar space from the container interior.

The sealable container according to [DDD], wherein the gasket is carried from the interior surface of the collar in a direction to be biased against and to extend beyond the internal edge of the sealing flange.

The sealable container according to [DDD], wherein the gasket is arranged to remain biased against the sealing flange when the lid is in an open position.

The sealable container according to [DDD], further comprising a removable seal extending across the opening and attaching to the sealing flange beneath the flexible gasket; and wherein the flexible gasket flexes to enable removal of the removable seal and thereafter flexes back to rest against the sealing flange.

[EEE] The sealable container according to [AAA], wherein the upper portion near the upper end of the walls defines a sealing flange having an internal edge that defines the opening to the interior space, and wherein the collar has an integral gasket projecting inwardly and in a direction to be biased against the sealing flange; and further comprising: a lid removably attached to the collar and having an interior surface which, when in a closed position, is adapted to cover and seal the opening, the lid having a sealing wall depending from its surface and projecting toward the sealing flange and being dimensioned to remain inward of the sealing flange when in the closed position.

The sealable container according to [EEE], wherein the integral gasket is carried from the interior surface of the collar in a direction to be biased against and to extend beyond the internal edge of the sealing flange.

The sealable container according to [EEE], further comprising a removable seal extending across the opening and attaching to the sealing flange beneath the integral gasket; and wherein the integral gasket flexes to enable removal of the removable seal and thereafter flexes back to rest against the sealing flange.

[FFF] The sealable container according to [EEE], wherein the lid further incorporates a substantially domed central section of dimensions less than the sealing wall and joined to the lid by an angled wall tapering from the domed central section down to the interior surface proximate to the sealing wall.

The sealable container according to [FFF], wherein the angled wall has an angle relative to a vertical direction of between approximately 20 degrees and approximately 60 degrees.

The sealable container according to [FFF], wherein, upon righting a disoriented container having contents, the angled wall and the sealing wall cooperate to direct the contents packed against the interior surface of the lid down into the interior space of the container to substantially prevent entry into the subcollar space.

[JJJ] A sealable container, comprising: walls defining interior and exterior surfaces and an interior space, the walls having an upper portion with a sealing flange defining an opening into the interior space; a collar assembly formed from the upper portion and the sealing flange having an interior surface adapted to fit about the upper portion; a removable lid attached to the collar assembly and pivotally movable between open and closed positions and to seal the container when in the closed position.

The sealable container according to [JJJ], further comprising: inwardly projecting alignment fins formed on the interior surface of the collar assembly, the alignment fins adapted to substantially align the collar assembly while being and once fitted about the upper portion.

The sealable container according to [JJJ], further comprising: a scoop holder projecting from an interior surface of the lid, the scoop holder having brackets with a cover and a restraint; wherein the scoop holder is adapted to removably retain a scoop having a handle extending from a bowl; and wherein when the scoop is retained in the scoop holder, the restraint captures the handle to prevent movement and the cover seals the bowl to prevent the contents from entering the bowl.

The sealable container according to [JJJ], further comprising: a removable seal affixed to the sealing flange and covering the opening into the interior space to seal the interior space.

A sealable container as described in the summary and detailed description of the invention.

A sealable container as illustrated in the figures of the invention.

Another aspect of the invention follows.

[AAAA] A sealable container, comprising: walls defining an interior and an exterior of the container, the walls having an exterior surface and an upper end thereof that defines an opening to said interior, the walls joining a bottom surface; walls defining interior and exterior surfaces and an interior space, the walls having an upper portion near an upper end of the walls that defines an opening to the interior space, the walls joining a bottom surface; a removable lid having an interior surface which, when in a closed position, is adapted to cover and seal the opening; and wherein the bottom surface comprises an outer planar portion for resting on a surface and a central raised stiffener portion directed towards the interior space in a plurality of steps having riser and tread portions, the riser portions projecting in a direction substantially upward relative to the outer planar portion and the tread portions being approximately parallel to the outer planar portion.

The sealable container according to [AAAA], further comprising: a removable seal affixed to the upper portion and sealing the interior space; and whereby after the container is closed and sealed at a first pressure, rupture of the seal is prevented when pressure external to the container is reduced below the first pressure as at least one of the plurality of steps compensates for the unequal pressure by collapsing toward the outer planar portion without extending beyond the planar portion.

The sealable container according to [AAAA], further comprising: a removable seal affixed to the upper portion and sealing the interior space; and whereby after the container is closed and sealed at one pressure, rupture of the seal is prevented when pressure external to the container is lower than the one pressure as at least one of the plurality of steps compensates for the unequal pressure by flexing toward the outer planar portion while maintaining a stacking clearance.

The sealable container according to [AAAA], whereby after the container is closed and sealed at one pressure, distention of the bottom wall is prevented with at least one of the plurality of steps being sized with a thickness resistant to a pressure differential when pressure external to the container is lower than the one pressure.

The sealable container according to [AAAA], wherein at least one of the riser and the tread portions of the plurality of steps has a reduced thickness relative others of the plurality that enables flexibility in response to a pressure differential.

The sealable container according to [AAAA], wherein at least one of the riser and the tread portions of the plurality of steps is formed to have a bellows configuration that establishes flexibility responsive to a pressure differential.

The sealable container according to [AAAA], wherein the walls joining each other and a bottom surface to define junctions having a particular cross-sectional geometry; and a scoop for removing contents from the interior space of the container, the scoop including a bowl with a rim having a cross-sectional geometry adapted to be substantially congruent with the particular cross-sectional geometry of the junctions between the walls and the walls and the bottom surface of the container.

What is claimed is:

1. A container comprising:

a plurality of walls defining an interior space and an upper portion having an exterior surface, the upper portion having a sealing flange with an internal edge that defines an opening to the interior space;

a collar attached to the upper portion;

a lid attached to the collar; and a seal attached to the sealing flange and covering the opening to the interior space, wherein the upper portion includes a plurality of discrete recesses spaced apart from one another around the exterior surface of the upper portion, and a plurality of discrete strengthening bridges disposed between adjacent ones of the plurality of discrete recesses and spaced apart from one another around the exterior surface of the upper portion, and wherein at least a portion of the collar covers at least part of a peripheral portion of the seal, and wherein the at least part of a peripheral portion of the seal is disposed between the collar and the sealing flange.

2. The container of claim 1, further comprising a tamper-indicating seal adhered to and extending between the lid and the collar to provide visual indication as to whether the lid has been opened.

3. The container of claim 2, wherein the tamper-indicating seal has at least one of a score line and at least one line of perforation between the lid and the collar.

4. The container of claim 1, wherein the seal is at least one of substantially moisture-impervious and oxygen-impervious.

5. The container of claim 1, wherein the lid is hingedly attached to the collar so that the lid may move between an open position and a closed position.

6. The container of claim 5, wherein the lid is hingedly attached to the collar by a living hinge.

7. The container of claim 1, further comprising a scoop holder capable of retaining a scoop above a product that is within the interior space of the container.

8. The container of claim 7, wherein the scoop has a handle and a bowl.

9. The container of claim 8, wherein the bowl has a rim with a cross-sectional geometry that is substantially congruent to the cross-sectional geometry of at least one junction between adjacent container walls.

10. The container of claim 1, wherein the seal is substantially moisture-impervious, oxygen-impervious, and light-impervious.

11. The container of claim 1, wherein the seal is attached to the sealing flange by a heat-sealable adhesive.

12. The container of claim 1, wherein the seal comprises a pull-tab.

13. The container assembly of claim 1, wherein the seal comprises one or more foil layers.

14. The container of claim 1, wherein the lid comprises:

a substantially domed central section; and a sealing wall that projects toward the sealing flange.

15. The container of claim 14, wherein the substantially domed central section comprises a wall that tapers between the substantially domed central section and a point that is proximate to the sealing wall.

16. The container of claim 1, wherein the lid comprises a collar engagement member that projects generally downward to a lip edge.

17. The container of claim 16, wherein the lip edge is configured to engage with a lip seat of the collar when the lid is in a closed position.

18. The container of claim 1, further comprising a locking feature that comprises:

a latch; and a keeper, wherein the latch is configured to engage the keeper in order to maintain the lid in a closed position.

19. The container of claim 1, wherein at least one of the plurality of walls comprises a recess positioned to facilitate gripping of the container.

20. The container of claim 1, further comprising a powdered infant formula within the interior space.

21. A container comprising:

a plurality of walls defining an interior space and an upper portion having an exterior surface, the upper portion having a sealing flange with an internal edge that defines an opening to the interior space;

a seal attached to the sealing flange and covering the opening to the interior space;

a collar attached to the upper portion; and a lid attached to the collar;

wherein the upper portion includes a recessed groove around the exterior surface of the upper portion, and a plurality of discrete strengthening bridges spaced apart from one another around and within the recessed groove, and wherein a plurality of discrete recesses are defined by the plurality of discrete strengthening bridges.

22. The container of claim 21, wherein the lid is hingedly attached to the collar so that the lid may move between an open position and a closed position.

23. The container of claim 22, wherein the lid is hingedly attached to the collar by a living hinge.

24. The container of claim 21, further comprising a scoop holder capable of retaining a scoop above a product that is within the interior space of the container.

25. The container of claim 24, wherein the scoop has a handle and a bowl.

26. The container of claim 25, wherein the bowl has a rim with a cross-sectional geometry that is substantially congruent to the cross-sectional geometry of at least one junction between adjacent container walls.

27. The container of claim 21, wherein the seal is substantially moisture-impervious, oxygen-impervious, and light-impervious.

28. The container of claim 21, wherein the seal is attached to the sealing flange by a heat-sealable adhesive.

29. The container of claim 21, wherein the seal comprises a pull-tab.

30. The container of claim 21, wherein the seal comprises one or more foil layers.

31. The container of claim 21, wherein the lid comprises:
a substantially domed central section; and
a sealing wall that projects toward the sealing flange.

32. The container of claim 31, wherein the substantially domed central section comprises a wall that tapers between the substantially domed central section and a point that is proximate to the sealing wall.

33. The container of claim 21, wherein the lid comprises a collar engagement member that projects generally downward to a lip edge.

34. The container of claim 33, wherein the lip edge is configured to engage with a lip seat of the collar when the lid is in a closed position.

35. The container of claim 21, further comprising a locking feature that comprises:
a latch; and
a keeper,
wherein the latch is configured to engage the keeper in order to maintain the lid in a closed position.

36. The container of claim 21, wherein at least one of the plurality of walls comprises a recess positioned to facilitate gripping of the container.

37. The container of claim 21, further comprising a powdered infant formula within the interior space.

38. A container assembly, comprising:
a. a receptacle having:
a bottom wall;
a front wall, a rear wall, a first side wall, and a second side wall;
a sealing flange with an internal edge that defines an opening to an interior space; and
a plurality of recesses spaced apart by strengthening bridges, the plurality of recesses and strengthening bridges being positioned on at least two opposing walls;
b. a lid-collar assembly comprising a collar and a lid,
the collar being joined to the receptacle, and
the lid being hingedly attached to the collar so that the lid may move between an open position and a closed position;
c. a seal attached to the sealing flange and extending across the opening;
d. a scoop comprising a handle and a bowl; and
e. a scoop holder capable of retaining the scoop above a product that is within the interior space of the receptacle.

39. The container assembly of claim 38, wherein at least a portion of the collar covers at least part of a peripheral portion of the seal, and wherein the at least part of a peripheral portion of the seal is disposed between the collar and the sealing flange.

40. The container assembly of claim 38, in which the collar covers the plurality of recesses and strengthening bridges.

41. The container assembly of claim 38, in which the receptacle comprises a groove running around an exterior periphery.

42. The container assembly of claim 41, wherein the recesses and strengthening bridges are positioned within the groove.

43. The container assembly of claim 38, wherein the lid is hingedly attached to the collar by a living hinge.

44. The container assembly of claim 38, wherein the seal is substantially moisture impervious and substantially oxygen impervious.

45. The container assembly of claim 38, wherein the seal is attached to the sealing flange by a heat-sealable adhesive.

46. The container assembly of claim 38, wherein the seal comprises a pull-tab.

47. The container assembly of claim 38, wherein the seal comprises one or more foil layers.

48. The container assembly of claim 38, wherein the lid comprises:
a substantially domed central section; and
a sealing wall that projects toward the sealing flange.

49. The container assembly of claim 48, wherein the substantially domed central section defines an area from about twenty percent and about eighty percent smaller than the entire area defined by the lid.

50. The container assembly of claim 38, wherein the substantially domed central section comprises a wall that tapers between a top surface of the domed central section and a point that is proximate to the sealing wall.

51. The container assembly of claim 38, wherein the lid comprises a collar engagement member that projects generally downward to a lip edge.

52. The container assembly of claim 51, wherein the lip edge is configured to engage with a lip seat of the collar when the lid is in a closed position.

53. The container assembly of claim 38, wherein the lid-collar assembly comprises from about 10% to about 40% of the height of the container assembly.

54. The container assembly of claim 38, wherein the bowl of the scoop has a rim with a cross-sectional geometry that is substantially congruent to the cross-sectional geometry of at least one of the following junctions: (i) the front wall and the first side wall, (ii) the front wall and the second side wall, (iii) the rear wall and the first side wall, and (iv) the rear wall and the second side wall.

55. The container assembly of claim 54, wherein the at least one junction is rounded.

56. The container assembly of claim 38, wherein a bottom surface of the container assembly and a top surface of the container assembly are configured so that a plurality of the container assemblies can be stacked.

57. The container assembly of claim 56, wherein the top surface of the container assembly comprises a first contour and the bottom surface of the container assembly comprises a second contour, the first and second contours being cooperative.

58. The container assembly of claim 38, wherein a bottom surface of the container assembly comprises a central raised stiffener portion.

59. The container assembly of claim 58, wherein the bottom surface of the container assembly further comprises a substantially flat portion surrounding the central raised stiffener portion.

60. The container assembly of claim 38, further comprising a locking feature having:
a latch; and
a keeper,
wherein the latch is configured to engage the keeper in order to maintain the lid in a closed position.

61. The container assembly of claim 38, further comprising a tamper-indicating seal is positioned across an interface between the lid and the collar.

62. The container assembly of claim 61, wherein the tamper-indicating seal comprises a score line or a line of perforation.

63. The container assembly of claim 38, wherein at least one of the front wall and the rear wall comprise a recess positioned to facilitate gripping of the container.

64. An infant formula product comprising:

i. a powdered infant formula;

ii. a scoop comprising a handle and a bowl; and iii. a container comprising:

a. a receptacle having:

a bottom wall;

a front wall, a rear wall, a first side wall, and a second side wall;

a sealing flange with an internal edge that defines an opening to an interior space; and a plurality of recesses spaced apart by strengthening bridges, the plurality of recesses and strengthening bridges being positioned on at least two opposing walls;

b. a lid-collar assembly comprising a collar and a lid, the collar being affixed to the receptacle, and the lid being hingedly attached to the collar so that the lid may move between an open position and a closed position;

c. a seal attached to the sealing flange and extending across the opening; and d. a scoop holder capable of retaining the scoop in a position in which the scoop is separated from the powdered infant formula;

wherein the powdered infant formula is located in the interior space of the receptacle.

65. The infant formula product of claim 64, wherein at least a portion of the collar covers at least part of a peripheral portion of the seal, and wherein the at least part of a peripheral portion of the seal is disposed between the collar and the sealing flange.

66. The infant formula product of claim 64, in which the collar covers the plurality of recesses and strengthening bridges.

67. The infant formula product of claim 64, in which the receptacle comprises a groove running around an exterior periphery.

68. The infant formula product of claim 67, wherein the recesses and strengthening bridges are positioned within the groove.

69. The infant formula product of claim 64, wherein the lid is hingedly attached to the collar by a living hinge.

70. The infant formula product of claim 64, wherein the seal is substantially moisture impervious and substantially oxygen impervious.

71. The infant formula product of claim 64, wherein the seal is attached to the sealing flange by a heat-sealable adhesive.

72. The infant formula product of claim 64, wherein the seal comprises a pull-tab.

73. The container assembly of claim 64, wherein the seal comprises one or more foil layers.

74. The infant formula product of claim 64, wherein the lid comprises:

a substantially domed central section; and a sealing wall that projects toward the sealing flange.

75. The infant formula product of claim 74, wherein the substantially domed central section defines an area from about twenty percent and about eighty percent smaller than the entire area defined by the lid.

76. The infant formula product of claim 64, wherein the substantially domed central section comprises a wall that tapers between a top surface of the domed central section and a point that is proximate to the sealing wall.

77. The infant formula product of claim 64, wherein the lid comprises a collar engagement member that projects generally downward to a lip edge.

78. The infant formula product of claim 77, wherein the lip edge is configured to engage with a lip seat of the collar when the lid is in a closed position.

79. The infant formula product of claim 64, wherein the lid-collar assembly comprises from about 10% to about 40% of the height of the container assembly.

80. The container assembly of claim 64, wherein the bowl of the scoop has a rim with a cross-sectional geometry that is substantially congruent to the cross-sectional geometry of at least one of the following junctions: (i) the front wall and the first side wall, (ii) the front wall and the second side wall, (iii) the rear wall and the first side wall, and (iv) the rear wall and the second side wall.

81. The infant formula product of claim 80, wherein the at least one junction is rounded.

82. The infant formula product of claim 64, wherein a bottom surface of the container assembly and a top surface of the container assembly are configured so that a plurality of the container assemblies can be stacked.

83. The infant formula product of claim 82, wherein the top surface of the container assembly comprises a first contour and the bottom surface of the container assembly comprises a second contour, the first and second contours being cooperative.

84. The infant formula product of claim 64, wherein a bottom surface of the container assembly comprises a central raised stiffener portion.

85. The infant formula product of claim 84, wherein the bottom surface of the container assembly further comprises a substantially flat portion surrounding the central raised stiffener portion.

86. The infant formula product of claim 64, further comprising a locking feature having:

a latch; and a keeper, wherein the latch is configured to engage the keeper in order to maintain the lid in a closed position.

87. The infant formula product of claim 64, further comprising a tamper-indicating seal is positioned across an interface between the lid and the collar.

88. The infant formula product of claim 87, wherein the tamper-indicating seal comprises a score line or a line of perforation.

89. The infant formula product of claim 64, wherein at least one of the front wall and the rear wall comprise a recess positioned to facilitate gripping of the container.

90. An infant formula product comprising:

i. a powdered infant formula;

ii. a scoop comprising a handle and a bowl; and iii. a container comprising:

a. a receptacle having:

a bottom wall;

a front wall, a rear wall, a first side wall and a second side wall;

a sealing flange with an internal edge that defines an opening to an interior space; and a plurality of recesses spaced apart by strengthening bridges, the plurality of recesses and strengthening bridges being positioned on at least two opposing walls;

b. a lid-collar assembly comprising a collar and a lid, the collar being affixed to the receptacle, the lid being hingedly attached to the collar so that the lid may move between an open position and a closed position;

the lid comprising at least a substantially domed central section;

a sealing wall that projects toward the sealing flange; and a collar engagement member that projects generally downward to a lip edge; and the lid-collar assembly comprising a latch and a keeper, the latch being configured to grip the keeper in order to maintain the lid in a closed position;

c. a seal attached to the sealing flange and extending across the opening, the seal being at least substantially impervious to moisture and oxygen; and d. a scoop holder capable of retaining the scoop in a position in which the scoop is separated from the powdered infant formula, wherein the powdered infant formula is located in the interior space of the receptacle.

91. The infant formula product of claim 90, wherein the bowl of the scoop has a rim with a cross-sectional geometry that is substantially congruent to the cross-sectional geometry of at least one of the following junctions: (i) the front wall and the first side wall, (ii) the front wall and the second side wall, (iii) the rear wall and the first side wall, and (iv) the rear wall and the second side wall.

92. The infant formula product of claim 91, wherein the at least one junction is rounded.

93. The infant formula product of claim 92, wherein the radius of the at least one junction is approximately equal to the radius of the rim of the bowl.

94. The infant formula product of claim 90, wherein a bottom surface of the container and a top surface of the container are configured so that a plurality of the containers can be stacked.

95. The infant formula product of claim 94, wherein the top surface of the container comprises a convex portion and the bottom surface of the container comprises a concave portion, the convex portion and the concave portion being cooperative.

96. The infant formula product of claim 90, wherein the container further comprises a tamper-indicating seal positioned across an interface between the lid and the collar.

97. The infant formula product of claim 90, wherein the lid is hingedly attached to the collar by a living hinge.

98. The infant formula product of claim 90, wherein at least a portion of the collar covers at least part of a peripheral portion of the seal, and wherein the at least part of a peripheral portion of the seal is disposed between the collar and the sealing flange.

* * * * *